US011394136B2

(12) United States Patent
Takeuchi et al.

(10) Patent No.: US 11,394,136 B2
(45) Date of Patent: Jul. 19, 2022

(54) TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi (JP)

(72) Inventors: Shunya Takeuchi, Mie (JP); Masaaki Tabata, Mie (JP); Teruo Hara, Mie (JP); Hiroki Kobayashi, Mie (JP); Takeshi Misaiji, Aichi (JP); Hiroshi Kobayashi, Aichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 17/055,281

(22) PCT Filed: May 16, 2019

(86) PCT No.: PCT/JP2019/019464
§ 371 (c)(1),
(2) Date: Nov. 13, 2020

(87) PCT Pub. No.: WO2019/225462
PCT Pub. Date: Nov. 28, 2019

(65) Prior Publication Data

US 2021/0126383 A1 Apr. 29, 2021

(30) Foreign Application Priority Data

May 25, 2018 (JP) ..... JP2018-100823

(51) Int. Cl.
*H01R 4/50* (2006.01)
*H01R 4/10* (2006.01)
(Continued)

(52) U.S. Cl.
CPC ..... *H01R 4/50* (2013.01); *H01R 4/10* (2013.01); *H01R 11/11* (2013.01); *H01R 13/4361* (2013.01)

(58) Field of Classification Search
None
See application file for complete search history.

(56) References Cited

U.S. PATENT DOCUMENTS 2,340,011 A 1/1944 Moore et al.
2,753,541 A * 7/1956 Leonard ..... H01R 4/5025 439/805

FOREIGN PATENT DOCUMENTS

CN 102113185 A 6/2011
EP 2301119 A2 3/2011
(Continued)

OTHER PUBLICATIONS

International Search Report dated Jul. 9, 2019 for WO 2019/225462 A1 (2 pages).

*Primary Examiner* — Ross N Gushi
(74) *Attorney, Agent, or Firm* — Venjuris, P.C.

(57) ABSTRACT

A female terminal 12 includes a terminal body 15 and a slider 16. The terminal body 15 includes an upper connecting piece 18A and a lower connecting piece 18B connected to a core wire 13 of an electric wire 11. The slider 16 is movable in a front-rear direction relative to the terminal body 15. The slider 16 includes an upper abutting portion 25A and a lower abutting portion 25B. The upper connecting piece 18A includes an upper protrusion 51A that abuts against the upper abutting portion 25A. The lower connect-
(Continued)

ing piece 18B includes a lower protrusion 51B that abuts against the lower abutting portion 25B.

8 Claims, 23 Drawing Sheets

(51) Int. Cl.
*H01R 11/11* (2006.01)
*H01R 13/436* (2006.01)

(56) References Cited

FOREIGN PATENT DOCUMENTS

| | | | |
|---|---|---|---|
| EP | 2301119 | B1 | 5/2015 |
| JP | S15-85 | Y1 | 1/1940 |
| JP | S55-085770 | U | 6/1980 |
| JP | 2007-059304 | A | 3/2007 |
| JP | 2015-156285 | A | 8/2015 |
| WO | 2010/002776 | A2 | 1/2010 |
| WO | 2010/002776 | A3 | 1/2010 |

* cited by examiner

TERMINAL

CROSS REFERENCE TO RELATED APPLICATIONS

This application is a national phase of PCT application No. PCT/JP2019/019464, filed on 16 May 2019, which claims priority from Japanese patent application No. 2018-100823, filed on 25 May 2018, all of which are incorporated herein by reference.

TECHNICAL FIELD

The technology disclosed herein relates to a terminal connected to an electric wire.

BACKGROUND

An electric wire including a core wire and a terminal connected to a bare end of the core wire has been known. An example of such a terminal may include a crimp portion that is crimped on the end of the core wire that is exposed.

The terminal may be crimped on the wire as follows. First, a sheet metal is processed to form the terminal in a predefined shape by pressing. Next, the terminal is placed on a setting portion of a lower die of a pair of dies that are movable relative to each other in the vertical direction. Next, the bare end of the core wire is placed on the crimp portion of the terminal. Then, one of or both of the dies are moved toward each other to sandwich the crimp portion between a pressing portion of an upper die and the setting portion of the lower die and to crimp the crimp portion on the core wire of the electric wire. Through these steps, the terminal is connected to the end of the wire (Japanese Patent Laid-open Publication No. 2007-059304).

PRIOR ART DOCUMENT

Patent Document

[Patent Document 1] Japanese Patent Laid-open Publication No. 2007-059304

SUMMARY OF THE INVENTION

Problem to be Solved

According to the technology describe above, relatively large equipment including the dies and a jig for crimping the crimp portion of the terminal on the core wire of the electric wire is required. Namely, equipment investment is required and thus a production cost may increase.

A virtual technology for solving the above problem may include a terminal that includes a terminal body and a slider. The terminal body may include a deformable connecting piece that extends in an extending direction. The slider is movable relative to the terminal body in the extending direction. The slider includes a pressing portion to press the connecting piece toward the electric wire.

According to the technology, the pressing portion of the slider presses the connecting piece toward the electric wire while the slider slides on the terminal body in the extending direction. The connecting piece is deformed toward the electric wire and pressed against the electric wire. The connecting piece is electrically connected to the electric wire. The terminal is electrically connected to the electric wire without using a relatively large jig such as a die.

However, according to the virtual technology, if a conductor included in the electric wire is provided with relatively large strength and thus the connecting piece is less likely to be deformed toward the electric wire, an excessively large force may be applied to the slider to slide the slider in the extending direction. The connecting piece may be bent in a direction different from the direction toward the electric wire, that is, the connecting piece may buckle.

The technology described herein was made in view of the above circumstances. An object is to provide a terminal including a connecting piece that is less likely to buckle.

Means to Solve the Problem

The technology described herein relates to a terminal that includes a terminal body and a slider. The terminal body includes at least one connecting piece extending in an extending direction and being deformable. The at least one connecting piece includes a contact surface and a receiving surface. The contact surface contacts an electric wire. The receiving surface is on an opposite side from the contact surface. The slider is movable in the extending direction relative to the terminal body. The slider includes an abutting portion that abuts against the receiving surface of the at least one connecting piece and presses the at least one connecting piece against the electric wire that is disposed on the contact surface of the at least one connecting piece along the extending direction. The at least one connecting piece includes a protrusion protruding from a section of the receiving surface in a direction from the contact surface toward the receiving surface.

According to the configuration, the abutting portion of the slider abuts against the protrusion of the connecting piece. According to the configuration, a contact area between the abutting portion and the receiving surface of the connecting piece can be reduced. Therefore, a force required for moving of the slider in the extending direction can be reduced. The connecting piece is less likely to buckle when pressed by the slider in the extending direction.

Preferred embodiments according to the technology described herein may include the following.

The protrusion may include a convex surface that is curved in a direction from the contact surface toward the receiving surface.

According to the configuration, because the protrusion of the connecting piece includes the convex surface, a contact area between the abutting portion and the protrusion is relatively small even if a misalignment occurs between the terminal body and the slider. Because precise relative positional alignment is not required for the terminal body and the slider, a production cost of the terminal can be reduced.

The protrusion may have a curvature that is larger at a distal end of the connecting piece than at a base end of the connecting piece.

According to the configuration, a section of the connecting piece closer to the base end is less likely to deform in comparison to a section of the connecting piece closer to the distal end. Therefore, the section of the connecting piece closer to the base end is less likely to buckle.

The protrusion may include a ridge section that extends in the extending direction.

According to the configuration, the abutting portion of the slider abuts against the protrusion of the connecting piece. According to the configuration, the contact area between the abutting portion and the receiving surface can be reduced. Therefore, the force required for moving of the slider in the extending direction can be reduced. The connecting piece is less likely to buckle when pressed by the slider in the extending direction.

The contact surface may include a recess that is recessed in a direction from the contact surface toward the receiving surface. The recess extends in the extending direction.

According to the configuration, the electric wire that is placed in the recess is less likely to be removed from the contact surface.

Effect of the Invention

According to the technology disclosed herein, the connecting piece included in the terminal is less likely to buckle.

DETAILED DESCRIPTION TO EXECUTE THE INVENTION

First Embodiment

A first embodiment according to the technology described herein will be described with reference to FIGS. 1 to 22. A connector 10 according to this embodiment holds female terminals 12 (an example of a terminal) connected to ends of electric wires 11. In the following description, a Z arrow, a Y arrow, and an X arrow point an upper side, a front side, and a left side, respectively. For components having the same configuration, some of the components may be indicated by reference signs and the rest of the components may not be indicated by the reference signs.

Figure 1:
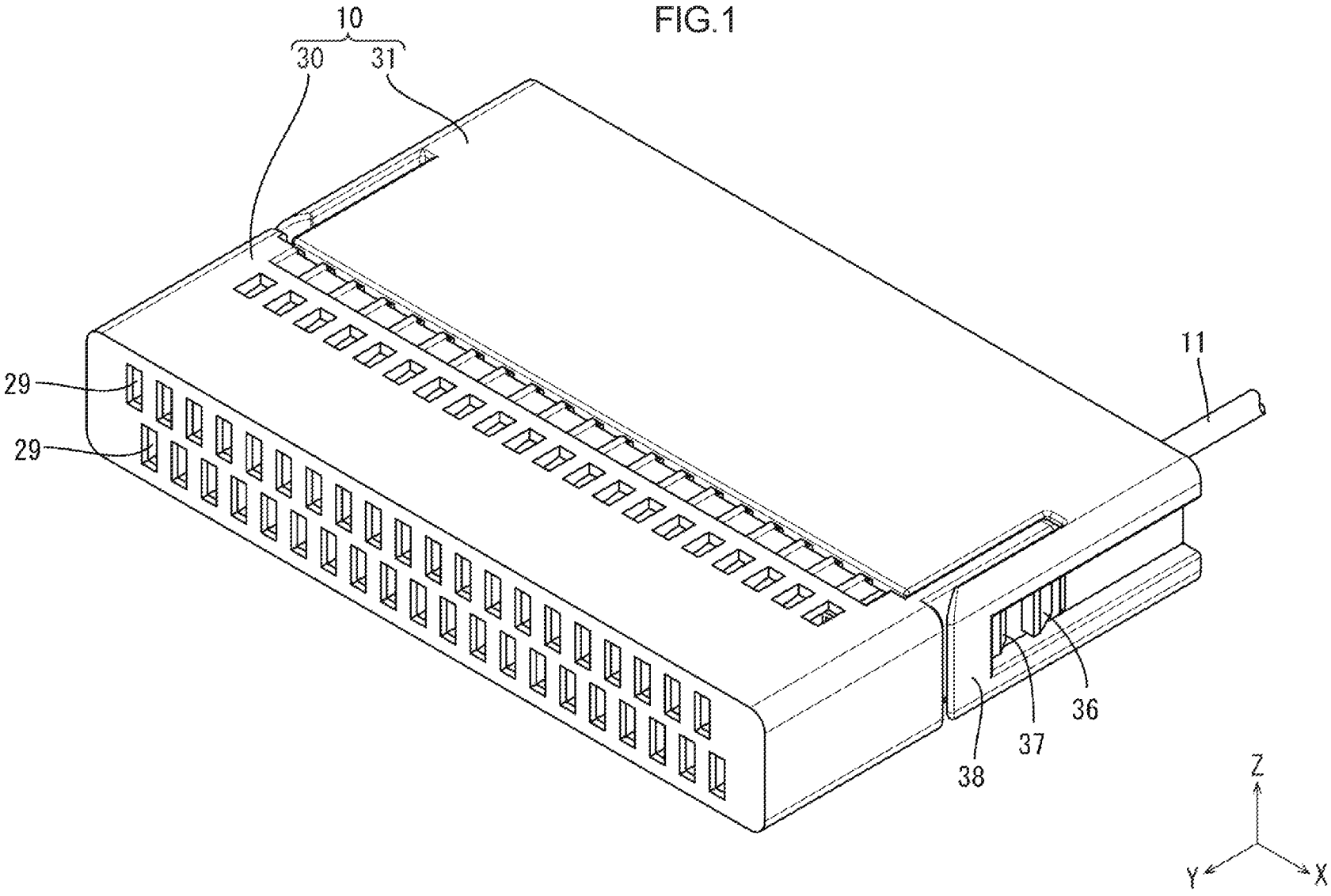
FIG. 1 is a perspective view illustrating a connector according to a first embodiment.
Figure 2:
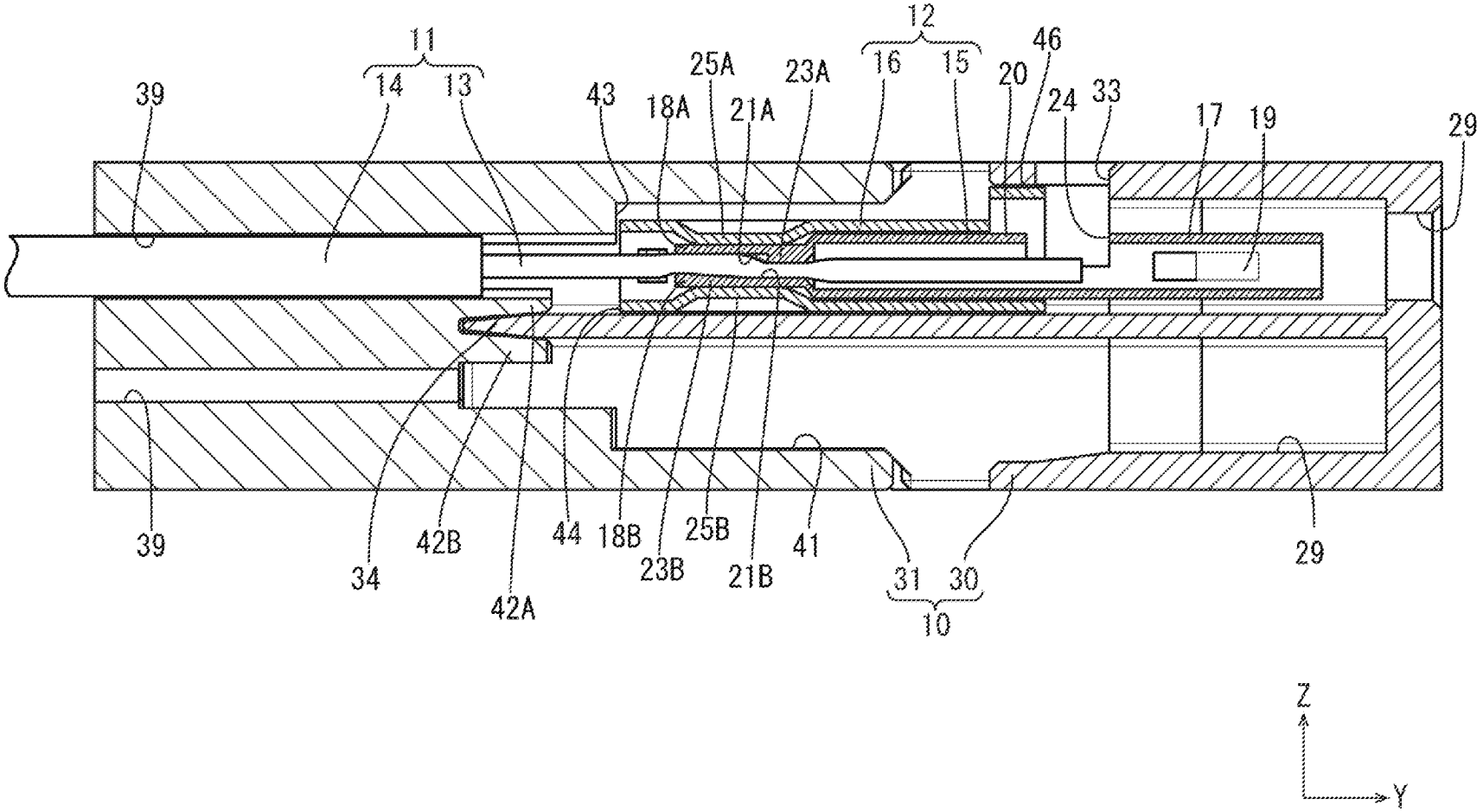
FIG. 2 is a cross-sectional view illustrating the connector.
Figure 3:
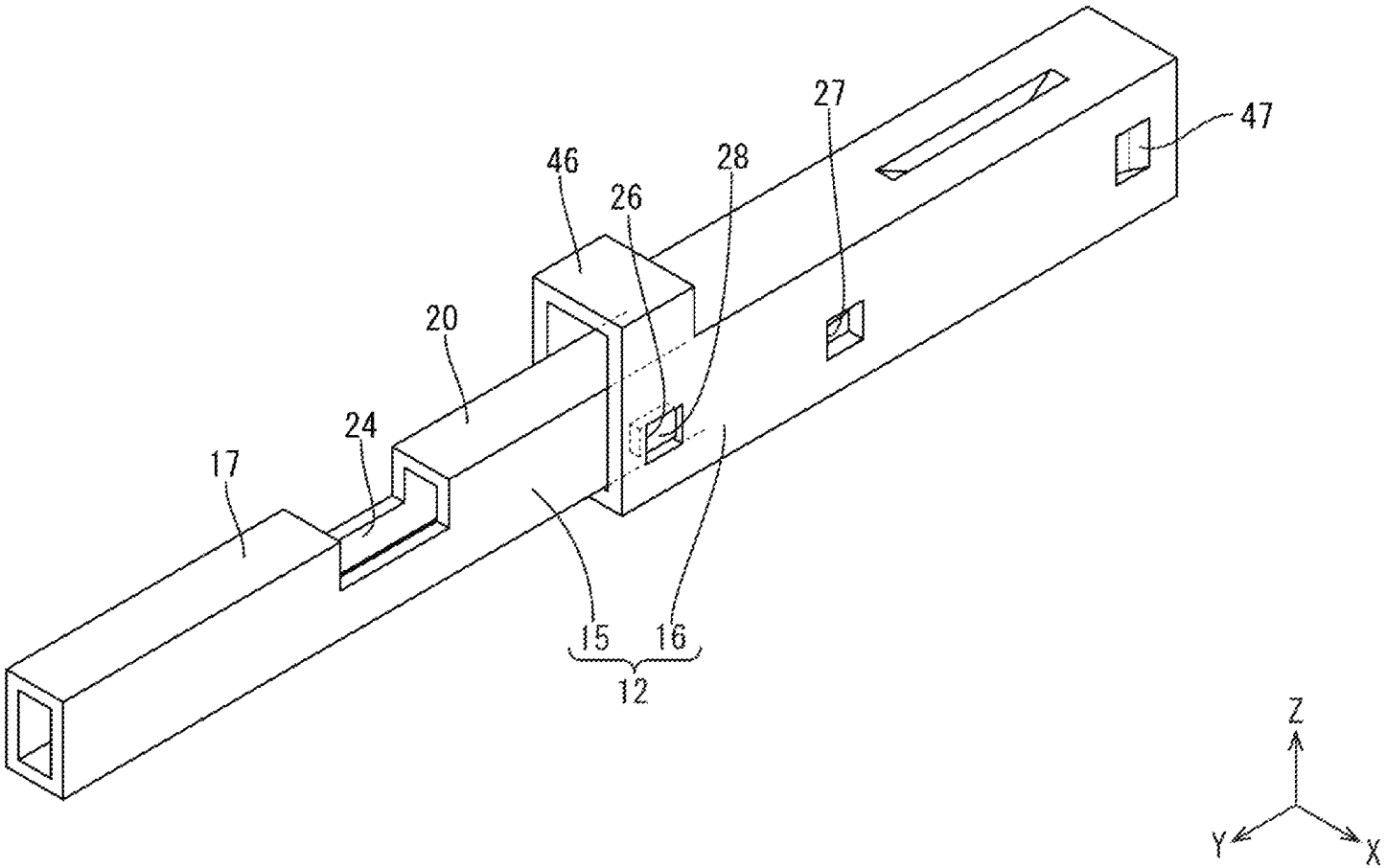
FIG. 3 is a perspective view illustrating a slider temporarily fitted on a terminal body.
Figure 4:
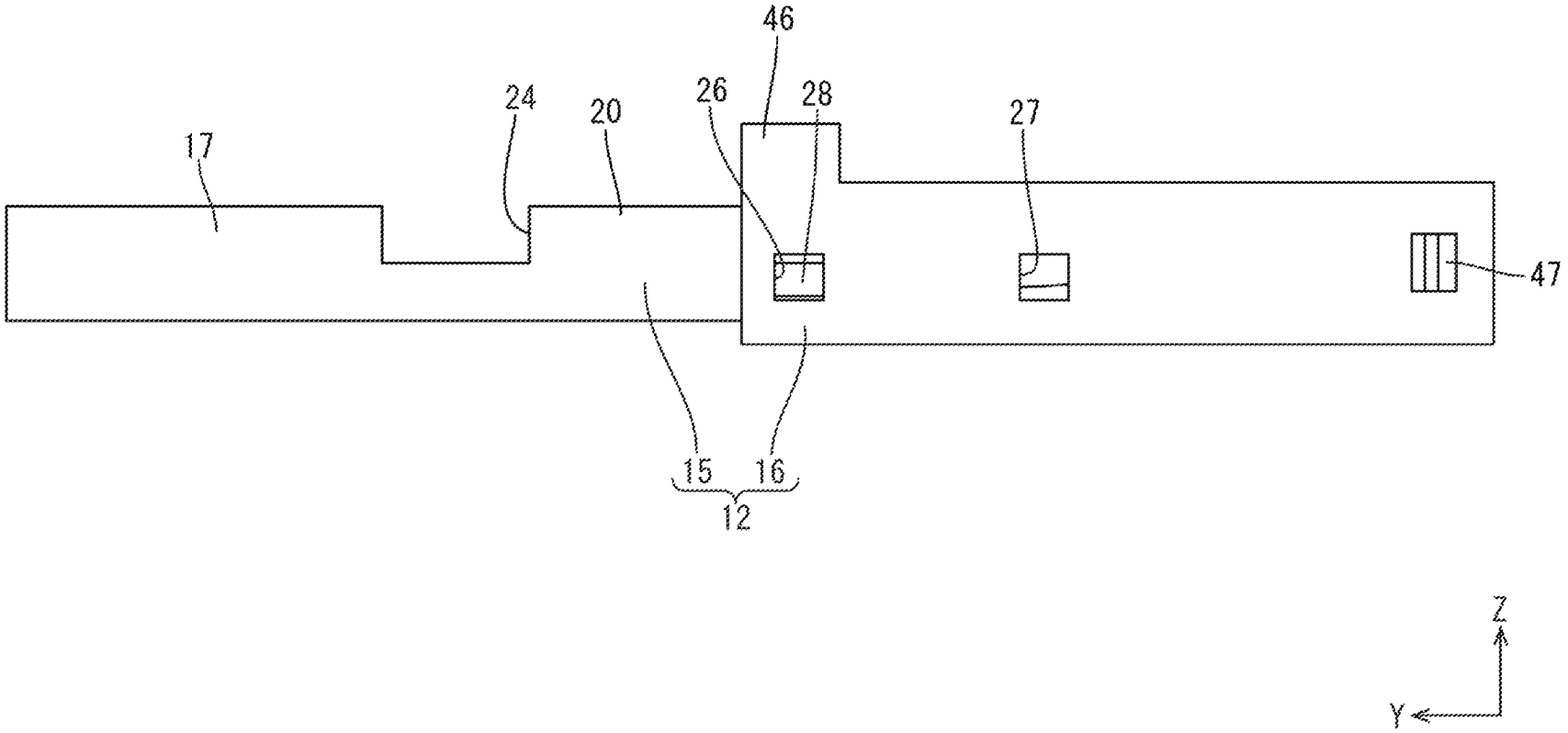
FIG. 4 is a side view illustrating the slider temporarily fitted on the terminal body.
Figure 5:
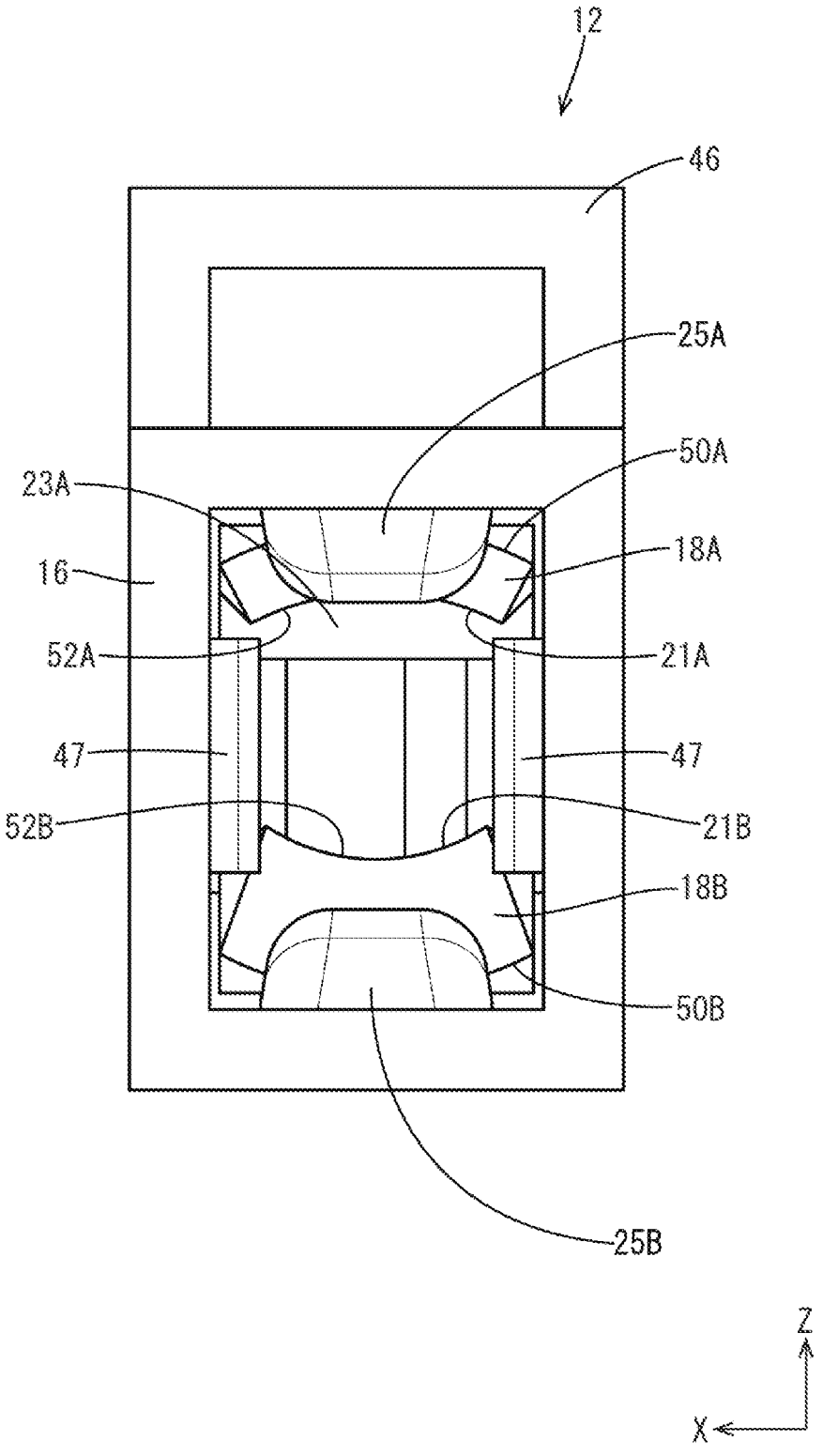
FIG. 5 is a rear view illustrating the slider temporarily fitted on the terminal body.
Figure 6:
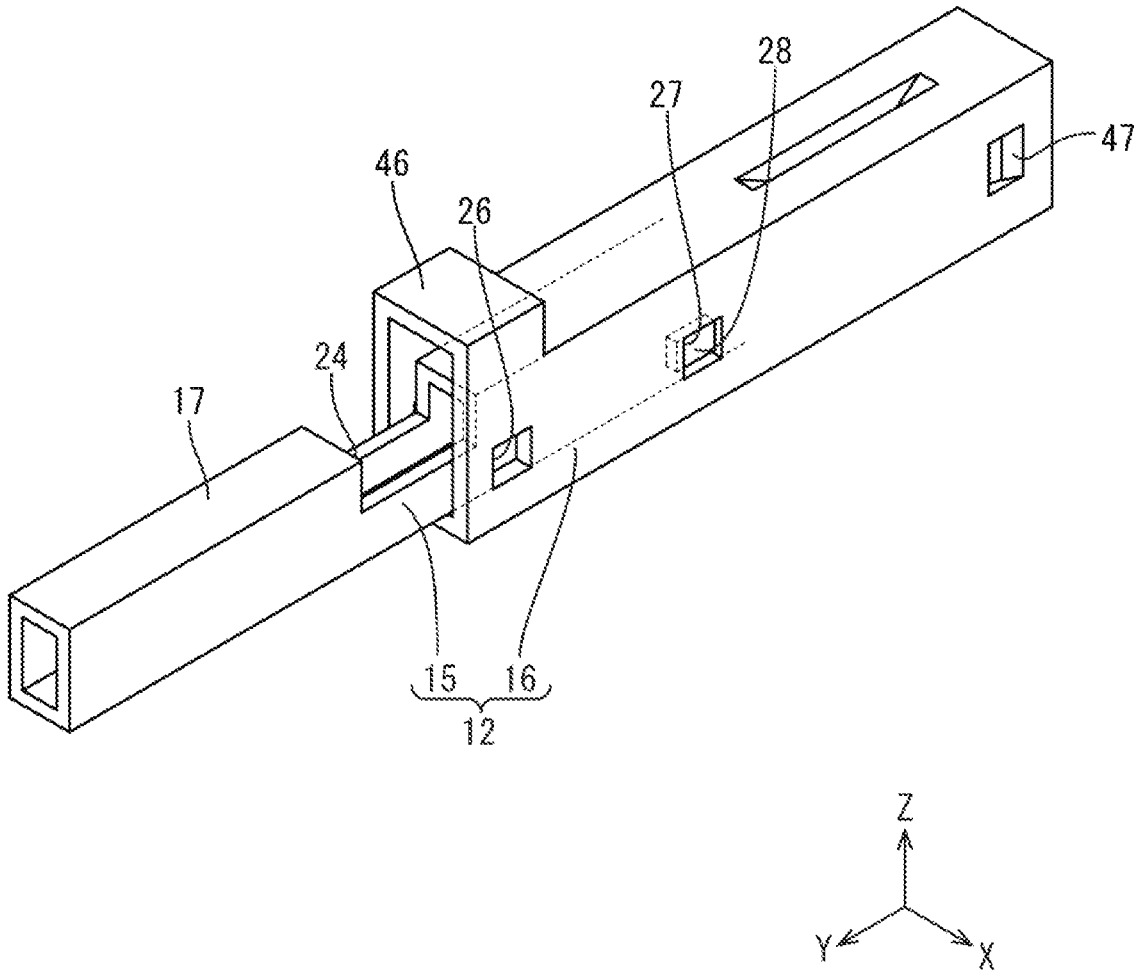
FIG. 6 is a perspective view illustrating the slider permanently fitted on the terminal body.
Figure 7:
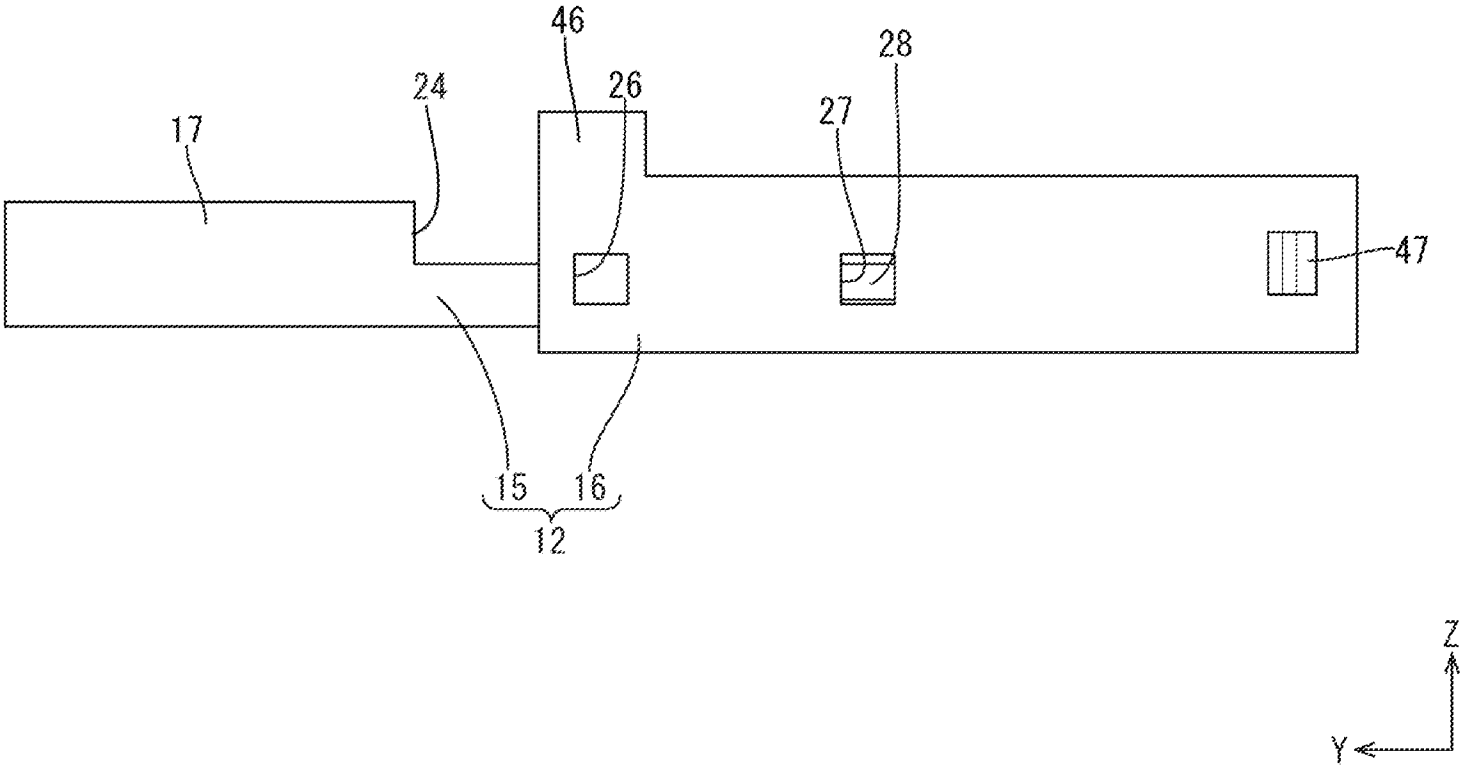
FIG. 7 is a side view illustrating the slider permanently fitted on the terminal body.

Electric Wire 11 As illustrated in FIG. 2, the electric wires 11 include core wires 13 covered with insulating sheaths 14 that are made of synthetic resin having insulating properties. End sections of the insulating sheaths 14 are stripped and the core wires 13 are exposed. Each of the core wires 13 in this embodiment is a single metal wire, that is, a single core wire. The core wire 13 may be a twisted wire including multiple fine metal wires that are twisted together. The metal of the core wire 13 may be copper, copper alloy, aluminum, aluminum alloy, or any other metals selected where appropriate. The core wire 13 in this embodiment is made of copper or copper alloy.

Female Terminal 12

As illustrated in FIGS. 3 to 7, the female terminals 12 include terminal bodies 15 and sliders 16. The terminal bodies 15 are made of metal. The sliders 16 are slidable relative to the respective terminal bodies 15.

Terminal Body 15 Each terminal body 15 is formed in a predefined shape by a known method including pressing, cutting, and casting. The terminal body 15 may be made of metal selected from any metals where appropriate such as copper, copper alloy, aluminum, aluminum alloy, and stainless steel. The terminal body 15 in this embodiment is made of copper or copper alloy. A plated layer may be formed on a surface of the terminal body 15. The plated layer may be made of metal selected from any metals where appropriate such as tin, nickel, and silver. A tin plated layer is formed on the terminal body 15 in this embodiment.

Figure 8:
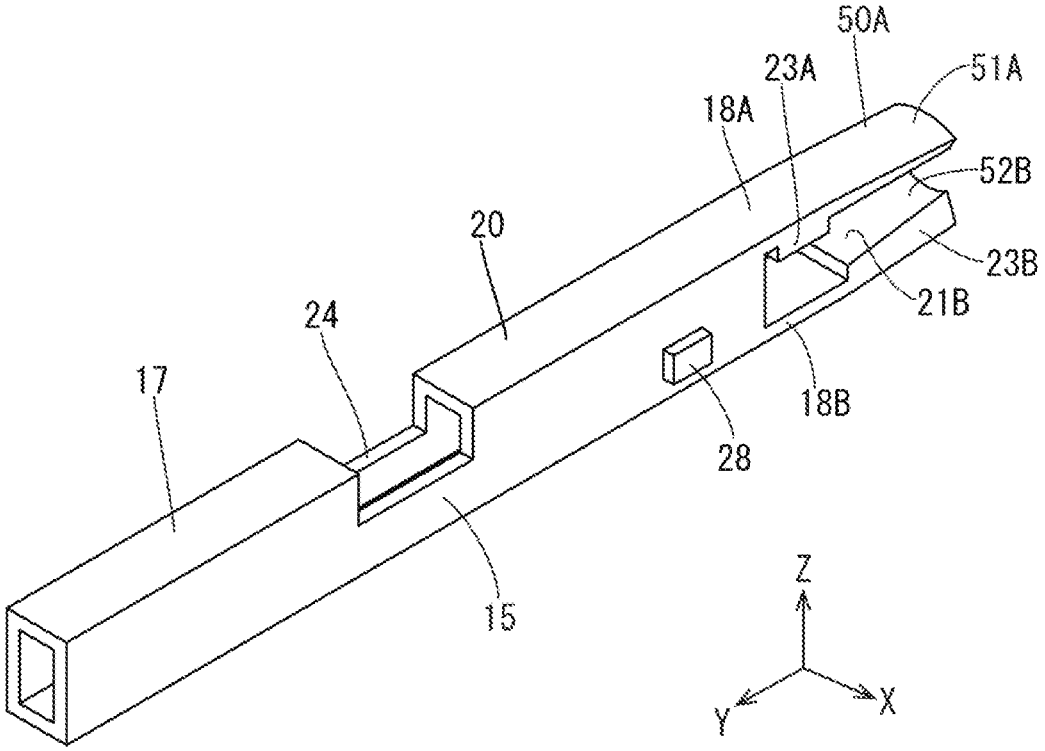
FIG. 8 is a perspective view of the terminal body.
Figure 9:
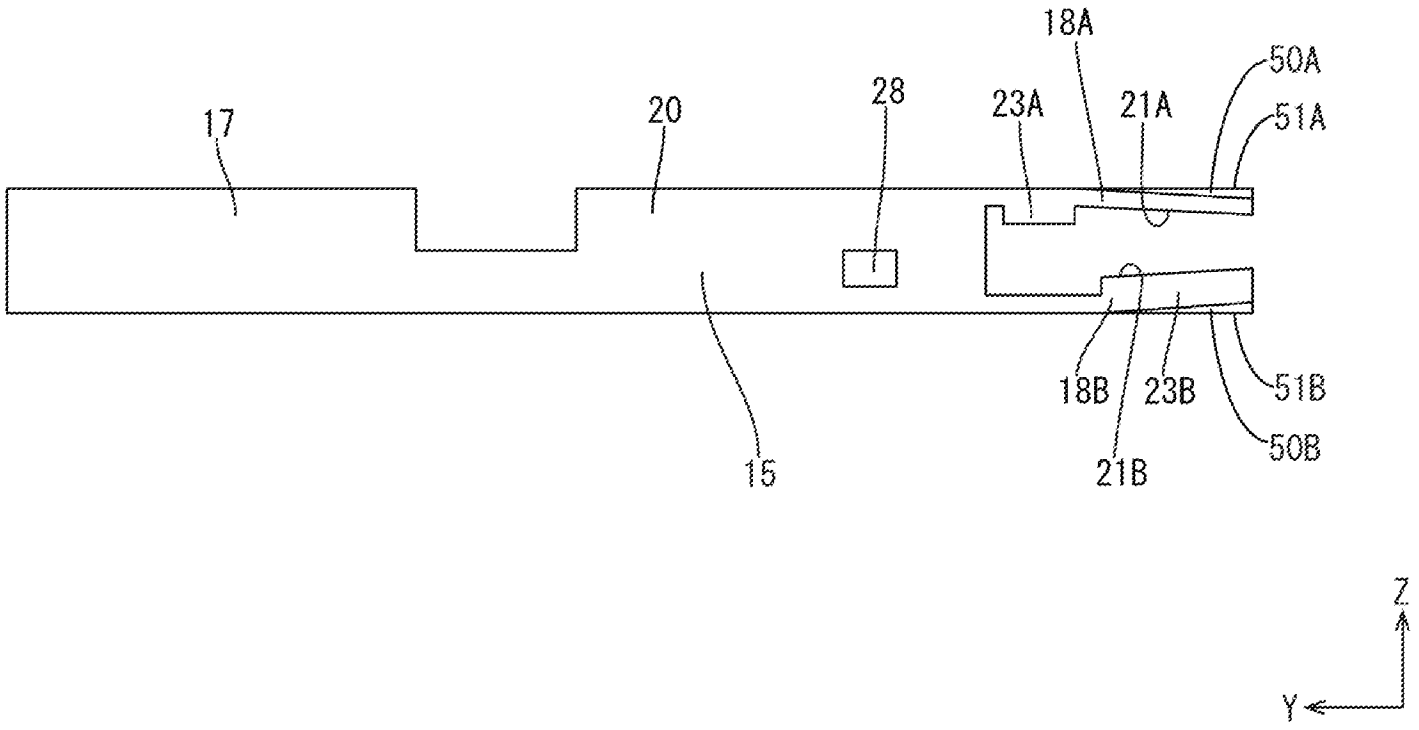
FIG. 9 is a side view of the terminal body.
Figure 10:
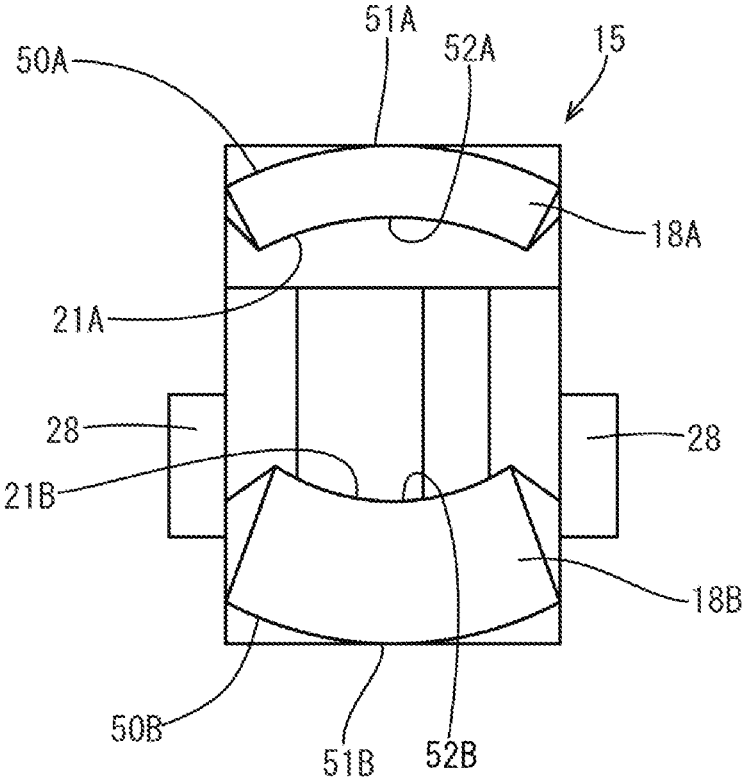
FIG. 10 is a rear view of the terminal body.
Figure 10:
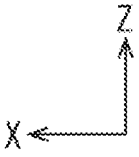

As illustrated in FIGS. 8 to 10, the terminal bodies 15 include connecting tube portions 17, upper connecting pieces 18A (an example of a connecting piece), and lower connecting pieces 18B (an example of a connecting piece). Mating male terminals (not illustrated) are inserted in the connecting tube portions 17. The upper connecting piece 18A and the lower connecting pieces 18B extend from rear ends of the connecting tube portions 17. Each connecting tube portion 17 has a rectangular tube shape extending in the front-rear direction. The connecting tube portions 17 include front ends that have openings through which the mating male terminals are inserted.

Flexible connecting pieces 19 are disposed inside the connecting tube portions 17 (see FIG. 2). The flexible connecting pieces 19 extend inward in the connecting tube portions 17. The flexible connecting pieces 19 are elastically deformable. The male terminals inserted in the connecting tube portions 17 contact the flexible connecting pieces 19.

The terminal bodies 15 include core wire receiving portions 20 behind the connecting tube portions 17. Each core wire receiving portion 20 has a rectangular tube shape. The core wires 13 are inserted in the core wire receiving portions 20. The upper connecting pieces 18A extend rearward from rear ends of upper walls of the core wire receiving portions 20. The lower connecting pieces 18B extend rearward from rear ends of lower walls of the core wire receiving portions 20. The upper connecting pieces 18A and the lower connecting pieces 18B have elongated shapes extending in the front-rear direction (an example of an extending direction). Lengths of each upper connecting piece 18A and each lower connecting piece 18B measuring in the front-rear direction are about equal to each other.

Upper Connecting Piece 18A

Each upper connecting piece 18A is formed to be elastically deformable in the top-bottom direction with the rear end of the core wire receiving portion 20 as a support point. The lower surfaces of the upper connecting pieces 18A are defined as upper contact surfaces 21A (an example of a contact surface) that contact the core wires 13. Upper holding protrusions 23A protrude downward from the upper contact surfaces 21A of the upper connecting pieces 18A. Each upper holding protrusion 23A is located at a position slightly more to the front than the rear end.

The upper surfaces of the upper connecting pieces 18A are defined as upper receiving surfaces 50A (an example of a receiving surface). Upper abutting portions 25A, which will be described later, abut against the upper receiving surfaces 50A from above. The upper receiving surfaces 50A of the upper connecting pieces 18A include upper protrusions MA (an example of a protrusion) that protrude upward (in a direction from the upper contact surface 21A toward the upper receiving surface 50A). The upper protrusions 51A in this embodiment include convex surfaces that are curved in a direction from the upper contact surfaces 21A toward the upper receiving surfaces 50A.

A curvature of each upper protrusion 51A on the upper receiving surface 50A of each upper connecting piece 18A is defined to continuously change from a base end of the upper connecting piece 18A to a distal end of the upper connecting piece 18A. In this embodiment, the curvature of the upper protrusion 51A is the smallest at a border between the core wire receiving portion 20 and the upper connecting piece 18A (at the base end) and the largest at the rear end of the upper connecting piece 18A (at the distal end).

The upper contact surfaces 21A of the upper connecting pieces 18A include upper recesses 52A that are recessed in a direction from the upper contact surfaces 21A toward the upper receiving surfaces 50A. The upper recesses 52A extend in the front-rear direction. A curvature of each upper recess 52A is defined such that the curvature continuously changes from the base end of each upper contact piece 18A to the distal end of the upper contact piece 18A. In this embodiment, the curvature of each upper recess 52A is the smallest at the border between the core wire receiving portion 20 and the upper connecting piece 18A (at the base end) and the largest at the rear end of the upper connecting piece 18A (at the distal end).

Each upper connecting piece 18A has an overall shape formed by curving an elongated metal plate extending in the front-rear direction such that a center in the right-left direction is the highest and right and left edges are lowered.

Lower Connecting Piece 18B

Each lower connecting piece 18B is formed to be elastically deformable in the top-bottom direction with the rear end of the core wire receiving portion 20 as a support point. The upper surfaces of the lower connecting pieces 18B are defined as lower contact surfaces 21B (an example of a contact surface) that contact the core wires 13, respectively. Lower holding protrusions 23B protrude upward at the rear ends of the lower contact surfaces 21B of the lower connecting pieces 18B. Each lower holding protrusion 23B is shifted from the corresponding upper holding protrusion 23A in the front-rear direction.

The lower surfaces of the lower connecting pieces 18B are defined as lower receiving surfaces 50B (an example of a receiving surface). Lower abutting portions 25B, which will be described later, abut against the lower receiving surfaces 50B from below. The lower receiving surfaces 50B of the lower connecting pieces 18B include lower protrusions 51B (an example of a protrusion) that protrude downward (in a direction from the lower contact surfaces 21B toward the lower receiving surfaces 50B). The lower protrusions 51B in this embodiment include convex surfaces that are curved in a direction from the lower contact surfaces 21B toward the lower receiving surfaces 50B.

A curvature of each lower protrusion 51B on the lower receiving surface 50B of each lower connecting piece 18B is defined such that the curvature continuously changes from a base end of the lower connecting piece 18B to a distal end of the lower connecting piece 18B. In this embodiment, the curvature of the lower protrusion 51B is the smallest at a border between the core wire receiving portion 20 and the lower connecting piece 18B (at the base end) and the largest at the rear end of the lower connecting piece 18B (at the distal end).

The lower contact surfaces 21B of the lower connecting pieces 18B include lower recesses 52B that are recessed in a direction from the lower contact surfaces 21B toward the lower receiving surfaces 50B. The lower recesses 52B extend in the front-rear direction. A curvature of each lower recess 52B is defined such that the curvature continuously changes from the base end of the lower contact piece 18B to the distal end of each lower contact piece 18B. In this embodiment, the curvature of each lower recess 52B is the smallest at the border between the core wire receiving portion 20 and the lower connecting piece 18B (at the base end) and the largest at the rear end of the lower connecting piece 18B (at the distal end).

Each lower connecting piece 18B has an overall shape formed by curving an elongated metal plate extending in the front-rear direction such that a center in the right-left direction is the lowest and right and left edges are raised.

When the core wires 13 contact the upper contact surfaces 21A of the upper connecting pieces 18A and the lower contact surfaces 21B of the lower connecting pieces 18B, the core wires 13 are electrically connected to the terminal bodies 15 (see FIG. 2).

Terminal Window 24

The terminal bodies 15 include terminal windows 24 more to the rear than the connecting tube portions 17 but more to the front than the core wire receiving portions 20. The terminal windows 24 open upward. Front ends of the core wires are detectable from the outside when the core wires 13 are disposed in spaces between the upper connecting pieces 18A and the lower connecting pieces 18B. The expression "detectable from the outside" means that, for example, the front ends of the core wires 13 are viewable from the outside by an operator, detectable by a camera (not illustrated) from the outside, or electrically detectable by a probe (not illustrated) from the outside.

Slider 16

Figure 11:
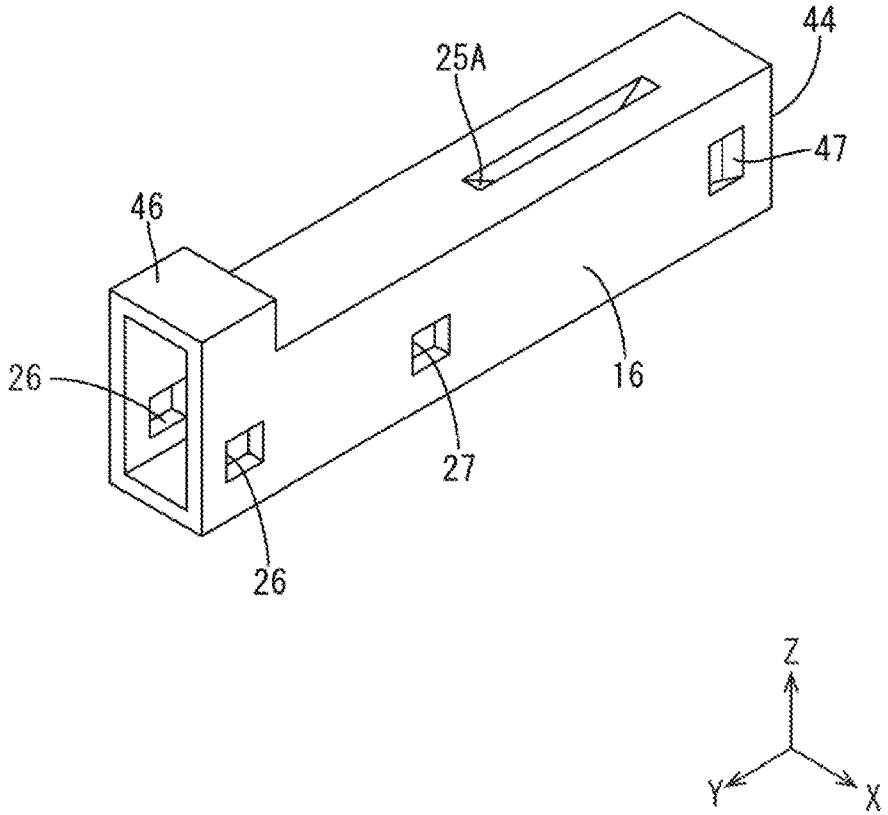
FIG. 11 is a perspective view of the slider.
Figure 12:
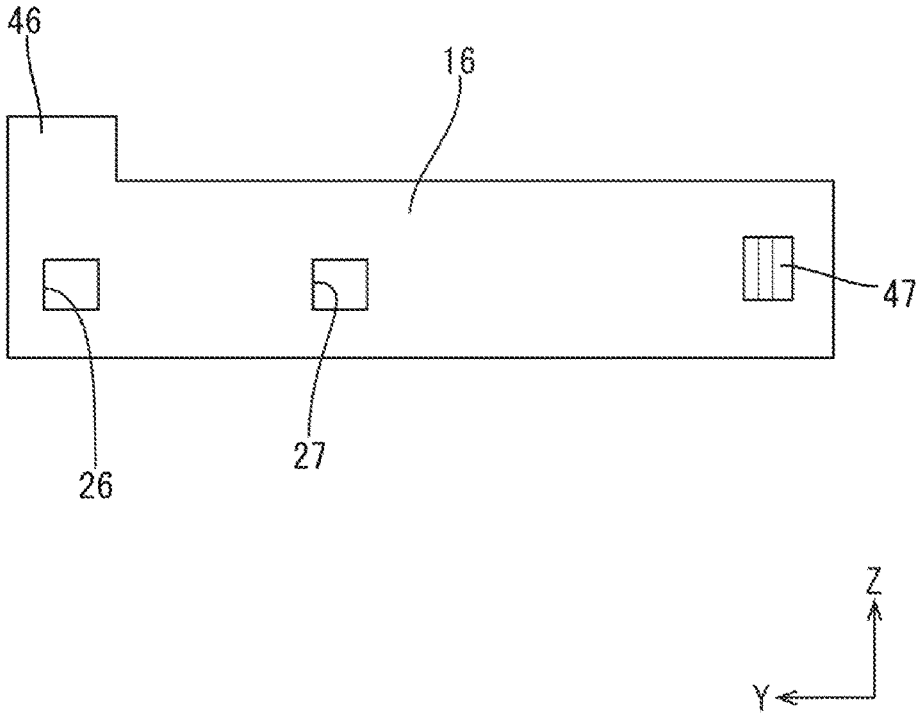
FIG. 12 is a side view of the slider.
Figure 13:
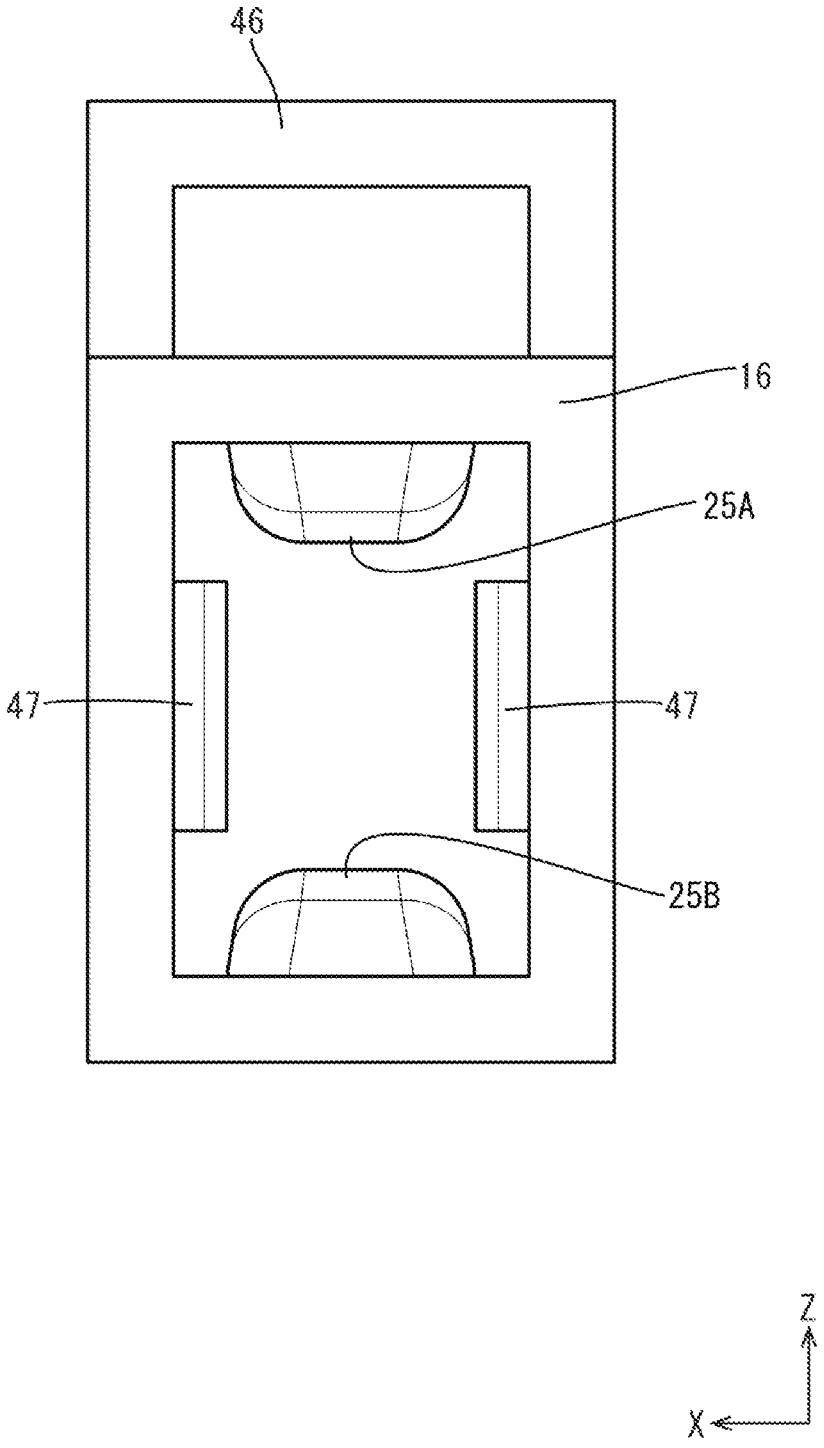
FIG. 13 is a rear view of the slider.

As illustrated in FIGS. 11 to 13, each slider 16 has a rectangular tube shape extending in the front-rear direction. The sliders 16 may be formed by a known method including cutting, casting, and pressing. The sliders 16 may be made of metal selected from any metal where appropriate such as copper, copper alloy, aluminum, aluminum alloy, and stainless steel. The sliders 16 in this embodiment may be made of copper or copper alloy. Plated layers may be formed on surfaces of the sliders 16. The plated layers may be made of metal selected from any metals where appropriate such as tin, nickel, and sliver. The sliders 16 in this embodiment are plated with tin.

Each slider 16 has a cross-sectional shape equal to or slightly larger than the cross-sectional shape of a section of the corresponding terminal body 15 including the upper connecting piece 18A and the lower connecting piece 18B. Therefore, the slider 16 is fitted on the section of the terminal body 15 including the upper connecting piece 18A and the lower connecting piece 18B.

The upper abutting portions 25A (an example of an abutting portion) protrude downward from the lower surfaces of upper walls of the sliders 16. The lower abutting portions 25B (an example of an abutting portion) protrude upward from the upper surfaces of lower walls of the sliders 16.

Sidewalls of the sliders 16 include temporary holding portions 26 having openings. The sidewalls of the slides 16 further include permanent holding portions 27 having openings. The permanent holding portions 27 are located more to the rear than the temporary holding portion 26. Fitting projections 28 on the sidewalls of the terminal bodies 15 can be elastically fitted in the temporary holding portions 26 or the permanent holding portions 27.

When the fitting projections 28 of the terminal bodies 15 are fitted in the temporary holding portions 26, the sliders 16 are held at temporary holding positions relative to the terminal bodies 15. At the positions, the upper abutting portions 25A and the lower abutting portions 25B of the sliders 16 are at separate positions more to the rear than the rear edges of the upper connecting pieces 18A and the lower connecting pieces 18B of the terminal bodies 15. Further, at this position, a distance between each upper connecting piece 18A and the corresponding lower connecting piece 18B is larger than a diameter of the corresponding core wire 13.

When the fitting projections 28 of the terminal bodies 15 are fitted in the permanent holding portions 27, the sliders 16 are held at permanent holding positions relative to the terminal bodies 15. At the positions, the upper abutting portions 25A of the sliders 16 contact surfaces of the upper connecting pieces 18A of the corresponding terminal bodies 15 on an opposite side from the upper contact surfaces 21A (on an upper side). Further, the lower abutting portions 25B of the sliders 16 contact surfaces of the lower connecting pieces 18B of the corresponding terminal bodies 15 on an opposite side from the lower contact surfaces 21B (on a lower side). Positions at which the sliders 16 are permanently fitted on the terminal bodies 15 are defined as contact positions at which the upper abutting portions 25A contact the upper connecting pieces 18A and the lower abutting portions 25B contact the lower connecting pieces 18B.

Each slider 16 is slidable between the temporary fitting holding position and the permanent holding position when the slider 16 is fitted on the section of the terminal body 15 including the upper connecting piece 18A and the lower connecting piece 18B. In this embodiment, the fitting projection 28 of each terminal body 15 functions as a permanent fitting portion and a temporary fitting portion.

When the slider 16 is held at the permanent holding position relative to the terminal body 15, the upper abutting portion 25A contacts the upper surface of the upper connecting piece 18A and the lower abutting portion 25B contacts the lower surface of the lower connecting piece 18B.

When the slider 16 is held at the permanent holding position relative to the terminal body 15, the upper abutting portion 25A presses the upper connecting piece 18A from above and the upper connecting piece 18A elastically deforms downward. When the lower abutting portion 25B presses the lower connecting piece 18B from below, the lower connecting piece 18B elastically deforms upward. When the core wire 13 is disposed in the space between the upper connecting piece 18A and the lower connecting piece 18B to extend in the front-rear direction (the extending direction) and the slider 16 is held at the permanent holding position relative to the terminal body 15, the core wire 13 is sandwiched between the upper connecting piece 18A and the lower connecting piece 18B that are elastically deformed in the top-bottom direction. Namely, the upper connecting piece 18A contacts the core wire 13 from above when the upper connecting piece 18A is pressed downward by the upper abutting portion 25A. The lower connecting piece 18B contacts the core wire 13 from below when the lower connecting piece 18A is pressed upward by the lower abutting portion 25B.

When the slider 16 is held at the permanent holding position relative to the terminal body 15, the upper holding projection 23A of the upper connecting piece 18A presses the core wire 13 from above and the lower holding protrusion 23B of the lower connecting piece 18B presses the core wire 13 from below. The core wire 13 is pressed by the upper holding projection 23A from above and by the lower holding projection 23B, which is at a position shifted from the upper holding protrusion 23A in the front-rear direction, from below. As a result, the core wire 13 remains bent in the top-bottom direction (a direction crossing the extending direction). The female terminal 12 is electrically connected to the core wire 13 via the upper holding projection 23A and the lower holding projection 23B.

The sliders 16 include jig contact portions 46 that protrude upward from the upper walls at the front ends of the sliders 16. When a jig 45 contacts each jig contact portion 46 from the rear and the slider 16 is pushed forward by the jig 45, the slider 16 moves forward (see FIG. 20). The jig 45 has an elongated plate shape or a rod shape. The jig 45 is made of a known material such as metal and synthetic resin. The jig 45 is relatively smaller than a die or equipment for moving the die. Therefore, an increase in cost related to the jig 45 is suppressed.

Each slider 16 includes a pair of guiding portions 47 that protrudes inward from right and left walls of the slider 16, respectively, at positions closer to the rear edge of the slider 16. Each of the guiding portions 47 has a width that decreases from the rear to the front. As the core wire 13 is rubbed against inner surfaces of the guiding portions 47, the core wire 13 is guided to an inner side of the slider 16.

Connector 10

As illustrated in FIG. 2, the connector 10 includes a connector housing 30 and a rear holder 31. The connector housing 30 includes multiple cavities 29 for holding the female terminals 12. The rear holder 31 is attached to a rear end of the connector housing 30.

Connector Housing 30

Figure 14:
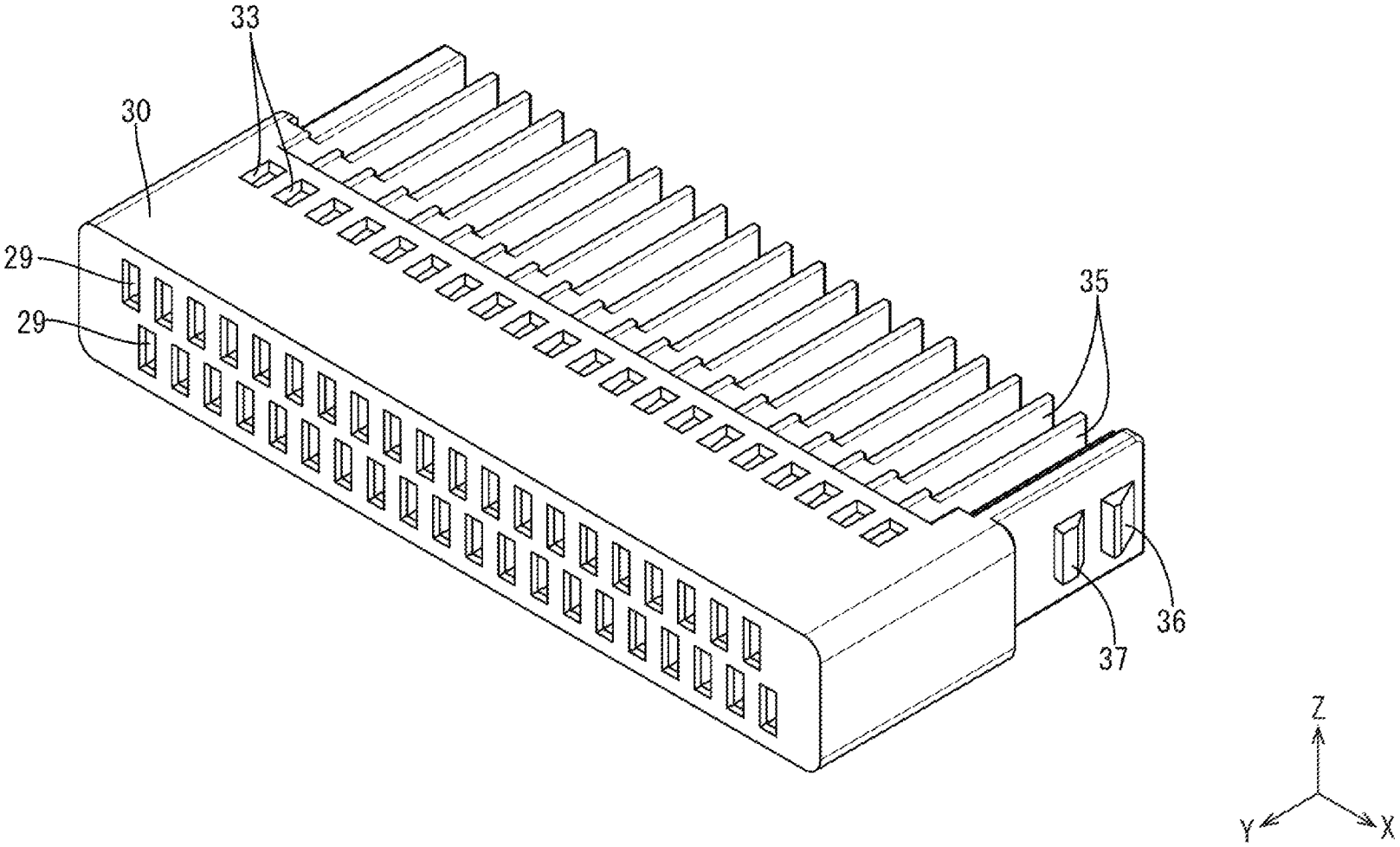
FIG. 14 is a perspective view illustrating a connector housing.
Figure 15:
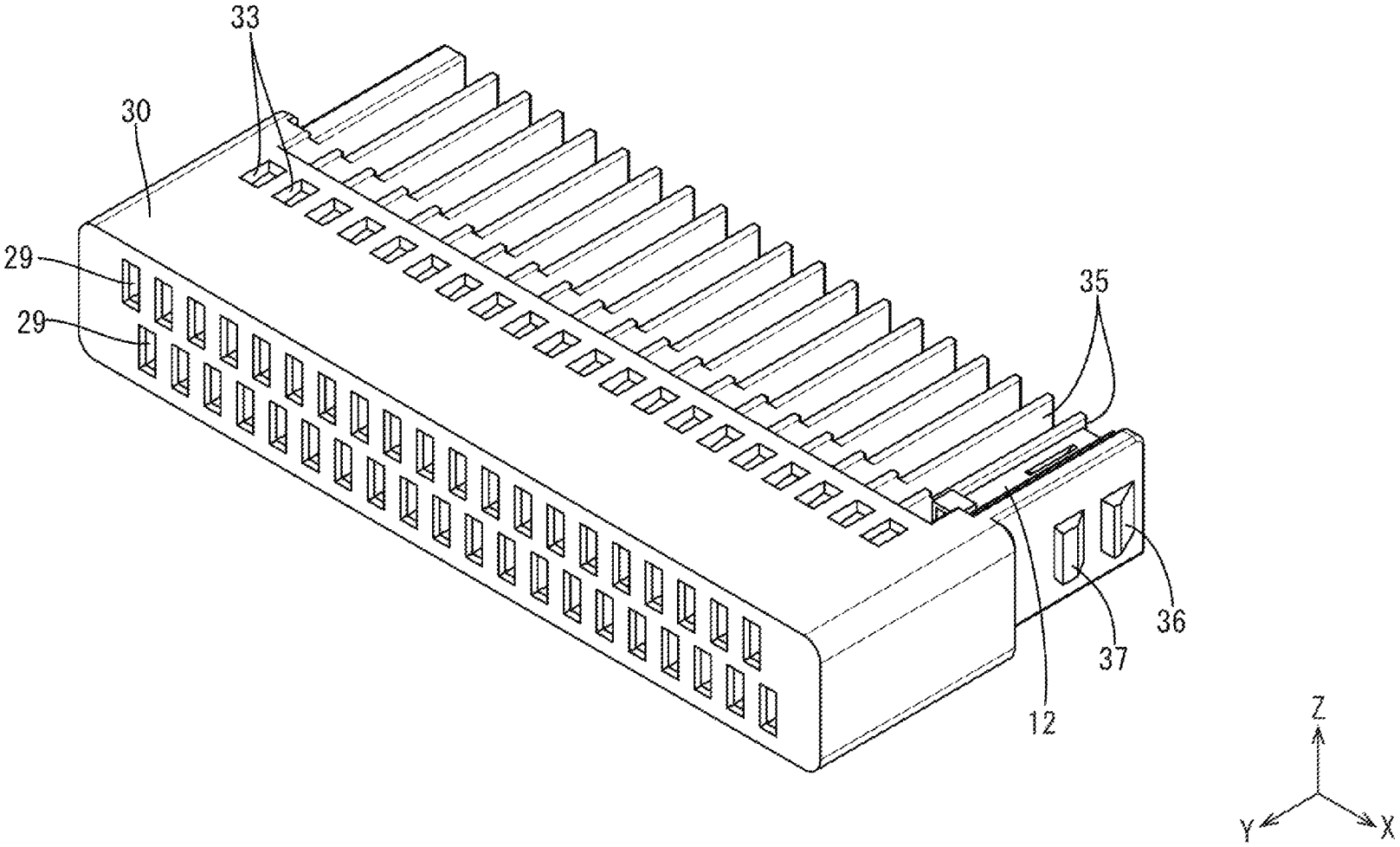
FIG. 15 is a perspective view illustrating the connector housing with a female terminal attached.
Figure 16:
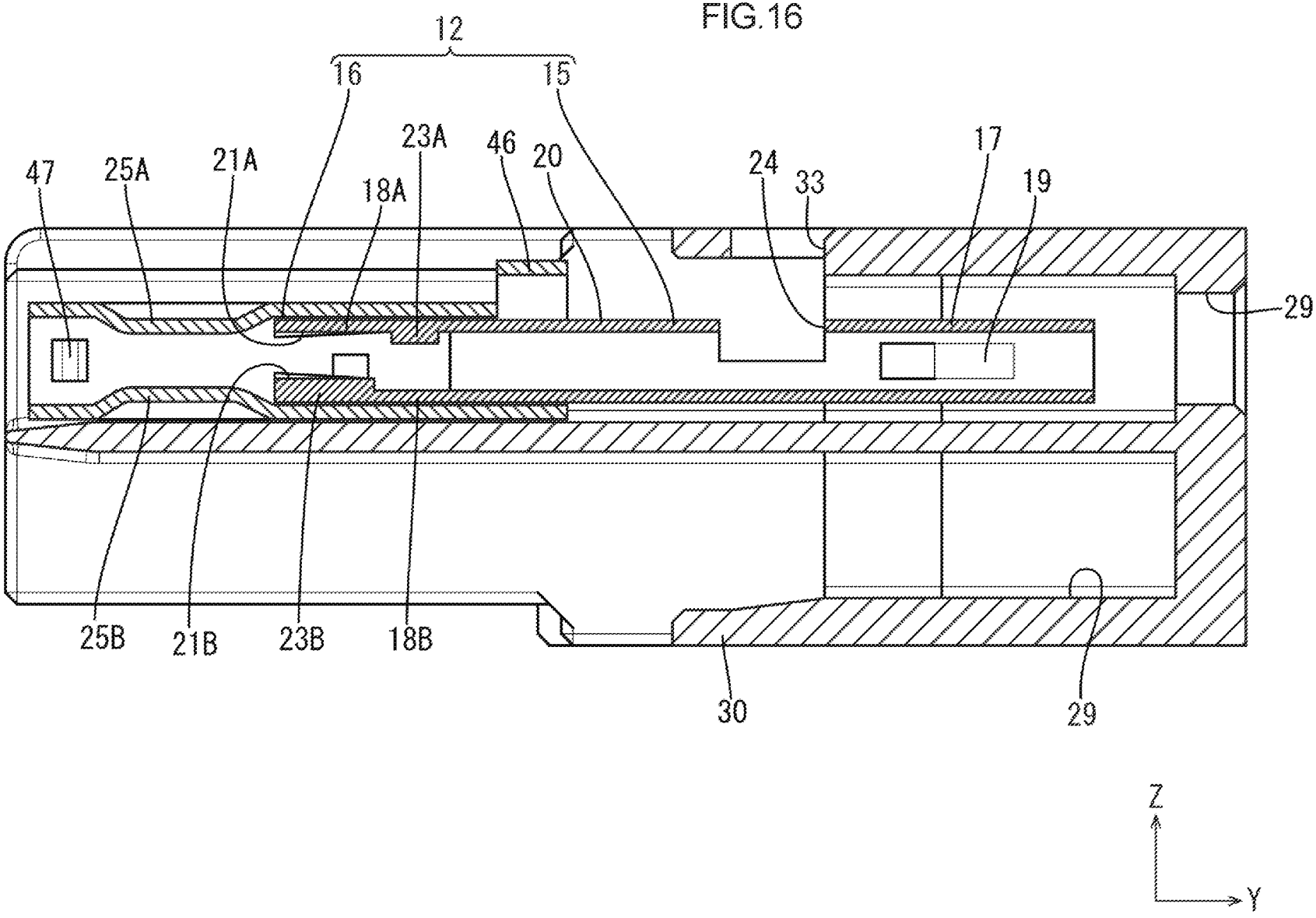
FIG. 16 is a cross-sectional view illustrating the connector housing with the female terminal attached.

As illustrated in FIG. 14, the connector housing 30 has a rectangular parallelepiped shape that is flattened in the top-bottom direction and elongated in the right-left direction. The connector housing 30 is formed from a synthetic resin having insulating properties by injection molding. The connector housing 30 includes the cavities 29 that extend in the front-rear direction for holding the male terminals 12 therein. The cavities 29 are separated from each other in the right-left direction and parallel to each other. The cavities 29 are arranged on two levels. The cavities 29 on an upper level and the cavities 29 on a lower level are shifted in the top-bottom direction. The number of the cavities 29 is not limited to any specific number. The number of the levels is not limited to two.

The cavities 29 have openings at the front ends through which male terminals can be inserted. The cavities 29 have openings at the rear ends through which the female terminals 12 can be received from the rear.

As illustrated in FIG. 2, connector windows 33 are provided at positions corresponding to the terminal windows 24 of the female terminals 12 when the female terminals 12 are held in the cavities 29. The connector windows 33 are drilled through walls that define the cavities 29. With the connector windows 33, the terminals windows 24 communicate with the outside. The terminal windows 24 of the female terminals 12 can be detectable from the outside through the connector windows 33. Through the connector windows 33 and the terminal windows 24, the front ends of the core wires 13 are detectable from the outside.

The connector housing 30 includes a dividing wall 34 that separates the upper level of the cavities 29 from the lower level of the cavities 29. The dividing wall 34 extends rearward from the rear ends of the cavities 29. The dividing wall 34 includes an upper surface and a lower surface from which partitions 35 protrude in the top-bottom direction. The partitions 35 are elongated in the front-rear direction. With the partitions 35, the female terminals 12 in the cavities that are adjacent to each other in the right-left direction are electrically isolated from each other.

The connector housing 30 includes temporary holding locks 36 that protrude outward from the right walls and the left walls, respectively, at positions closer to the rear end. Permanent holding locks 37 protrude outward from the right walls and the left walls, respectively, at positions more to the front than the temporary holding locks 36.

Rear Holder 31

The rear holder 31 has a box shape with an opening on the front side. The rear holder 31 is formed from a synthetic resin having insulating properties by injection molding. The rear holder 31 is fitted on a rear half of the connector housing 30. The rear holder 31 includes lock receiving portions 38 in a right wall and a left wall at positions closer to a front end. The temporary holding locks 36 or the permanent holding locks 37 may be elastically fitted in the lock receiving portions 38. Each of the lock receiving portions 38 has a rectangular U shape.

When the temporary holding locks 36 of the connector housing 30 are fitted in the lock receiving portions 38 of the rear holder 31, the rear holder 31 is held at a temporary holding position relative to the connector housing 30. When the permanent holding locks 37 of the connector housing are fitted in the lock receiving portions 38, the rear holder 31 is held at a permanent holding position relative to the connector housing 30.

The rear holder 31 includes insertion holes 39 in which the electric wires 11 are inserted. The insertion holes 39 are separated from each other in the right-left direction and parallel to each other. The insertion holes 39 are arranged on two levels. The insertion holes 39 are located corresponding to the cavities 29 of the connector housing 30.

An inner diameter of each insertion hole 39 is equal to or slightly larger than an outer diameter of the insulating sheath 14 of each electric wire 11.

The rear holder 31 includes a hood portion 41 in which the connector housing 30 is fitted. The hood portion 41 has an opening on the front side. The rear holder 31 includes two projections walls 42A and 42B that project forward in the hood portion 41 at about the middle of the rear hood holder 31 in the top-bottom direction and a the rear end of the hood portion 41. The projection walls 42A and 42B are separated from each other in the top-bottom direction. A distance between the projection walls 42A and 42B in the top-bottom direction is equal to or slightly larger than a thickness of the dividing wall 34 of the connector housing 30 measuring in the top-bottom direction.

When the rear holder 31 is held at the temporary holding position relative to the connector housing 30, the projecting walls 42A and 42B of the rear holder 31 are located more to the rear than the rear edge of the dividing wall 34 of the connector housing 30. When the rear holder 31 is held at the permanent holding position relative to the connector housing 30, the dividing wall 34 of the connector housing 30 is fitted between the projecting walls 42A and 42B of the rear holder 31. According to the configuration, the rear holder 31 is less likely to be displaced in the top-bottom direction relative to the connector housing 30.

An inner wall of the hood portion 41 includes a section slightly more to the rear than the front edge of the hood portion 41 thinner than other sections. According to the configuration, the inner wall of the hood portion 41 includes a step between the section closer to the front edge and a rear section. The step is defined as a slider abutting portion 43 that abuts against the rear ends 44 of the sliders 16 from the rear when the rear holder 31 is moved from the temporary holding position to the permanent holding position relative to the connector housing 30.

Assembling of Connector 10

Next, assembling of the connector 10 according to this embodiment will be described. Steps of the assembling of the connector 10 are not limited to those described below.

The terminal bodies 15 and the sliders 16 are formed by know methods. Each slider 16 is attached to the corresponding terminal body 15 from the rear. The front end of the slider 16 contacts the fitting projection 28 of the terminal body 15 from the rear and the sidewall of the slider 16 expands outward. When the slider 16 is pushed forward, the sidewall of the slider 16 is restored and the fitting projection 28 is fitted in the temporary holding portion 26 of the slider 16. As a result, the slider 16 is held at the temporary holding position relative to the terminal body 15. Each female terminal 12 (see FIG. 3) is prepared as above.

The connector housing 30 and the rear holder 31 are prepared from the synthetic resin by injection molding. The female terminals 12 are inserted into the cavities 29 of the connector housing 30, respectively, from the rear (see FIGS. 15 and 16).

Figure 17:
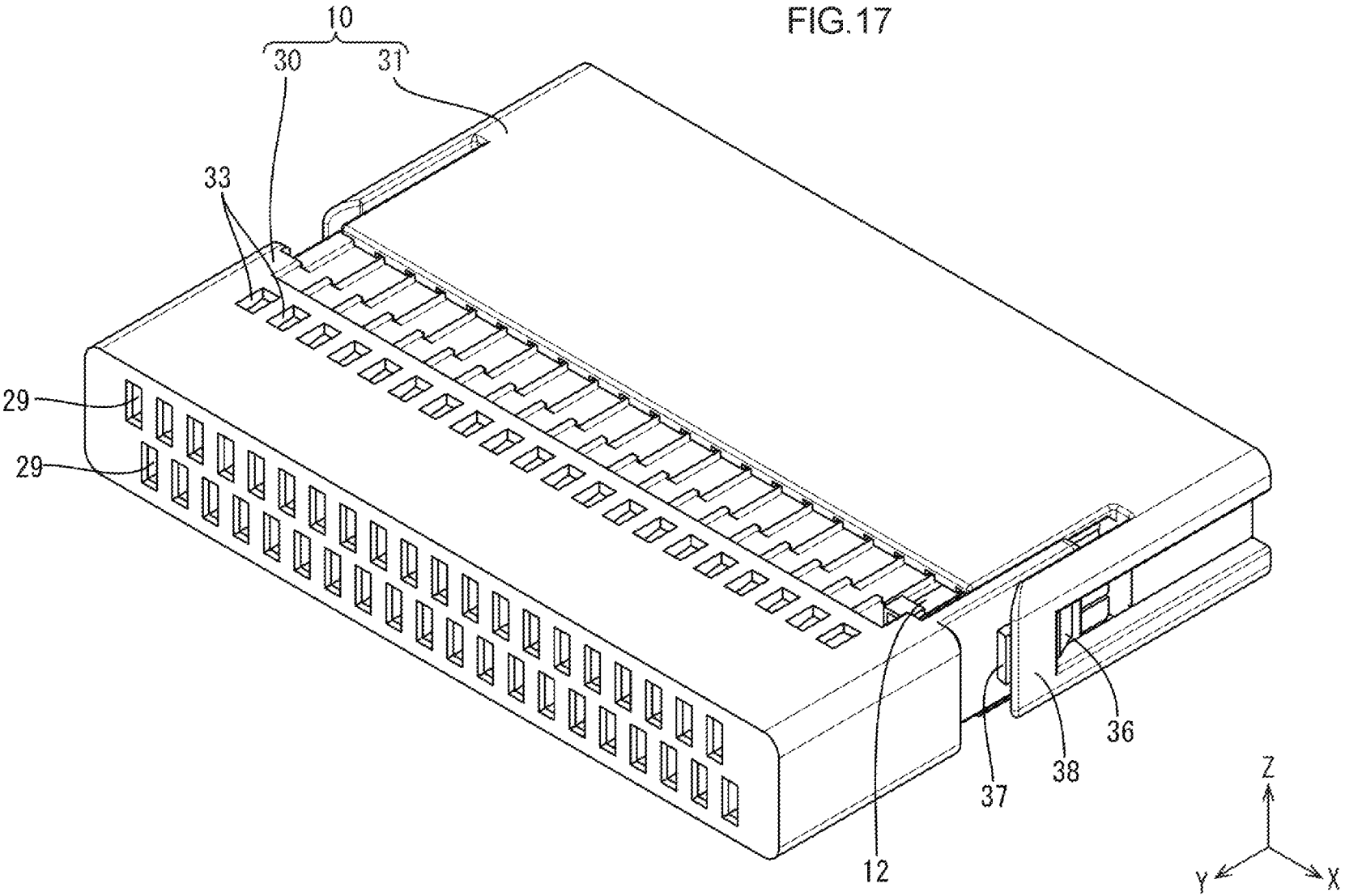
FIG. 17 is a perspective view illustrating the connector housing with a rear holder attached at a temporary fitting position.
Figure 18:
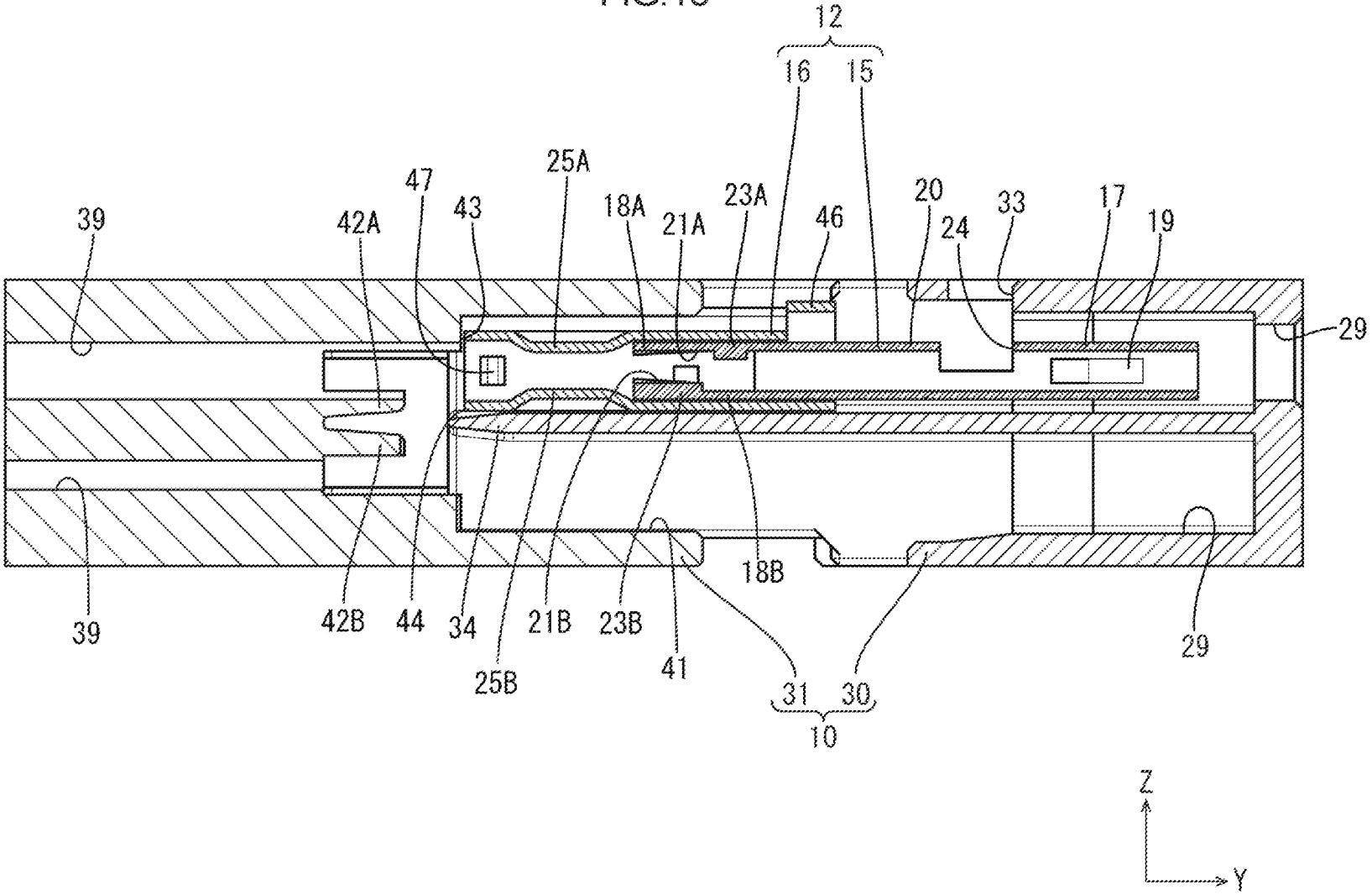
FIG. 18 is a cross-sectional view illustrating the connector housing with the rear holder attached at the temporary fitting position.
Figure 19:
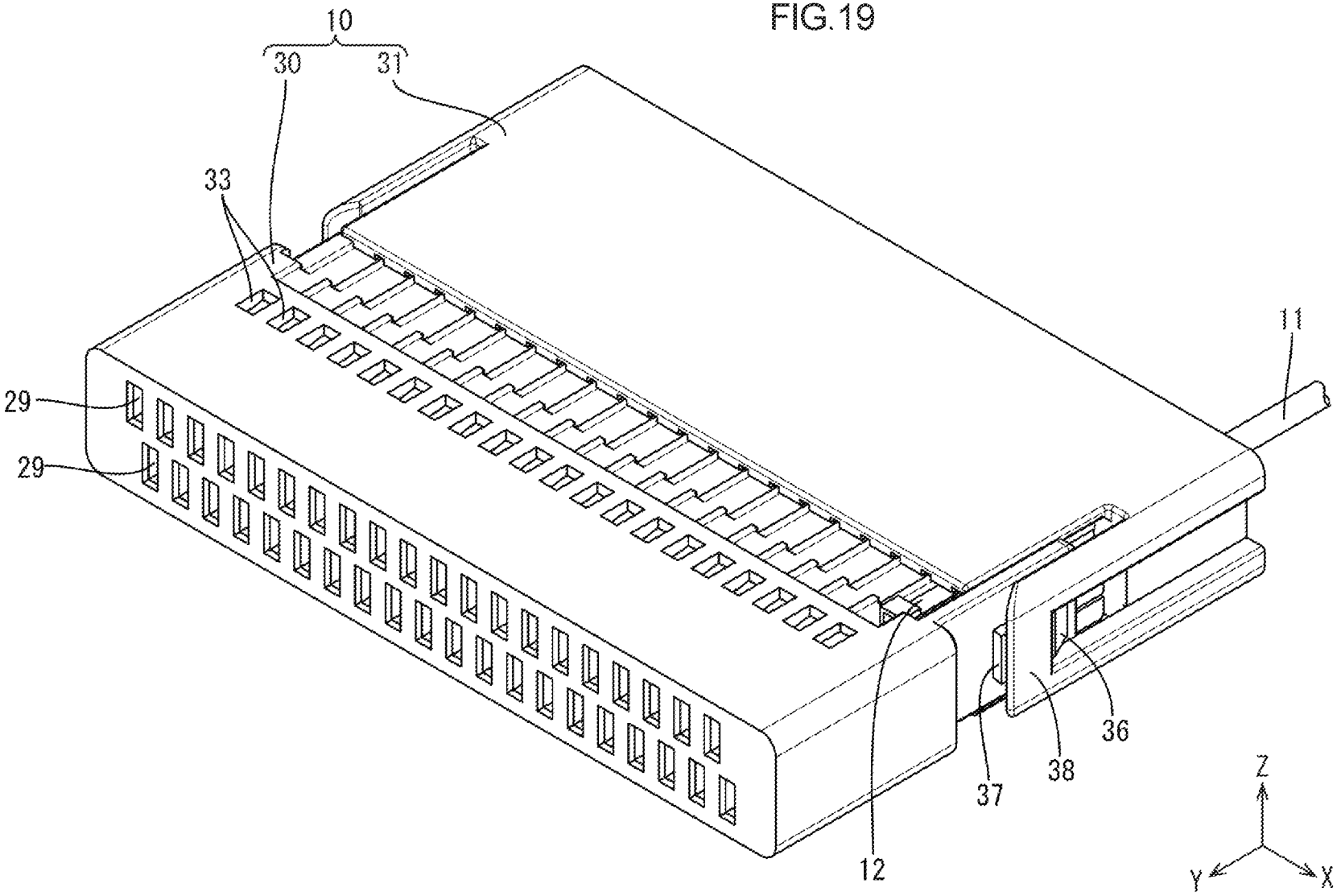
FIG. 19 is a perspective view illustrating the connector housing with an electric wire inserted.

As illustrated in FIGS. 17 and 18, the rear holder 31 is attached to the rear end portion of the connector housing 30 from the rear. The front end of the rear holder 31 contacts the temporary holding locks 36 of the connector housing 30 from the rear and the front end of the rear holder 31 expands outward. The rear holder 31 is pushed forward, the front end of the rear holder 31 is restored and the temporary holding locks 36 of the connector housing 30 are elastically fitted in the lock receiving portions 38 of the rear holder 31. As a result, the rear holder 31 is held at the temporary holding position relative to the connector housing 30. At the position, the slider abutting portion 43 of the rear holder 31 is separated from the rear edges of the sliders 16 and located more to the rear than the rear edges.

The section of the insulating sheath 14 at the end of each electric wire 11 is stripped so that a section of each core wire 13 with a predefined length is exposed. The front end of the core wire 13 is inserted in the corresponding insertion hole 39 in the rear end portion of the rear holder 31.

When the electric wire 11 is pushed farther forward, the front end of the core wire 13 projects forward from the insertion hole 39 of the rear holder 31 and is guided to the inside of the slider 16 via the rear end 44 of the slider 16. As the core wire 13 contacts the guiding portion 47 of the slider 16, the core wire 13 is guided into the slider 16. When the electric wire 11 is pushed farther forward, the front end of the core wire 13 enters into the terminal body 15 and then into the space between the upper connecting piece 18A and the lower connecting piece 18B.

When the electric wire 11 is pushed farther forward, the front end of the core wire 13 reaches below the terminal window 24 of the terminal body 15 (see FIG. 20). The front end of the core wire 13 is detectable by viewing or with a probe in the terminal window 24 that is viewable through the connector window 33. At this position, the insulating sheath 14 of the electric wire 11 is located within the insertion hole 39 of the rear holder 31.

When the slider 16 is held at the temporary holding position relative to the terminal body 15 and the rear holder 31 is held at the temporary holding position relative to the connector housing 30, the distance between the upper connecting piece 18A and the lower connecting piece 18B is larger than the outer diameter of the core wire 13. Therefore, the core wire 13 is less likely to rub against the upper connecting piece 18A and the lower connecting piece 18B during insertion of the core wire 13 into the connector 10. Namely, the electric wire 11 can be inserted into the connector with a reduced force.

Figure 20:
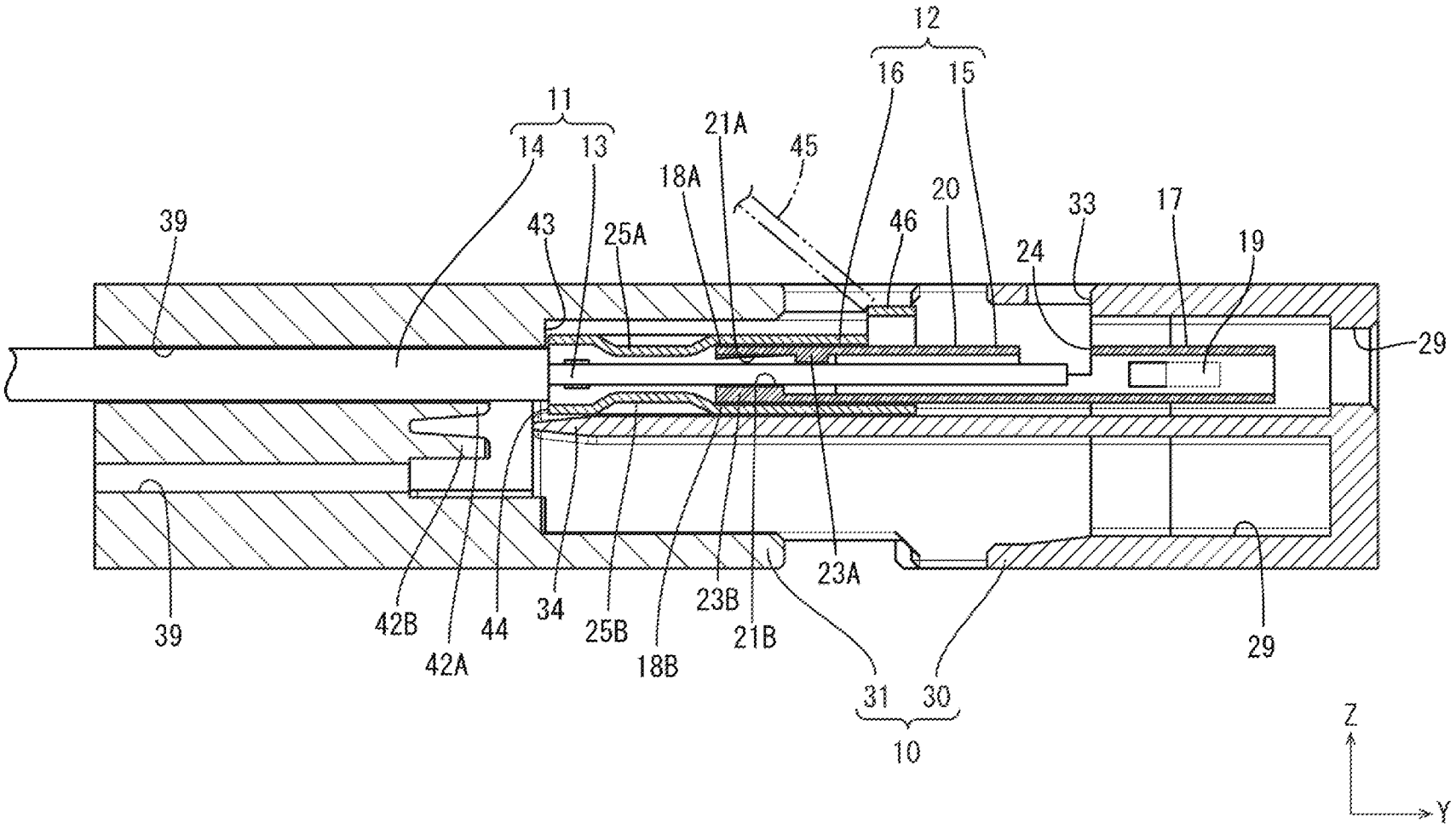
FIG. 20 is a cross-sectional view illustrating the connector housing with the electric wire inserted.
Figure 21:
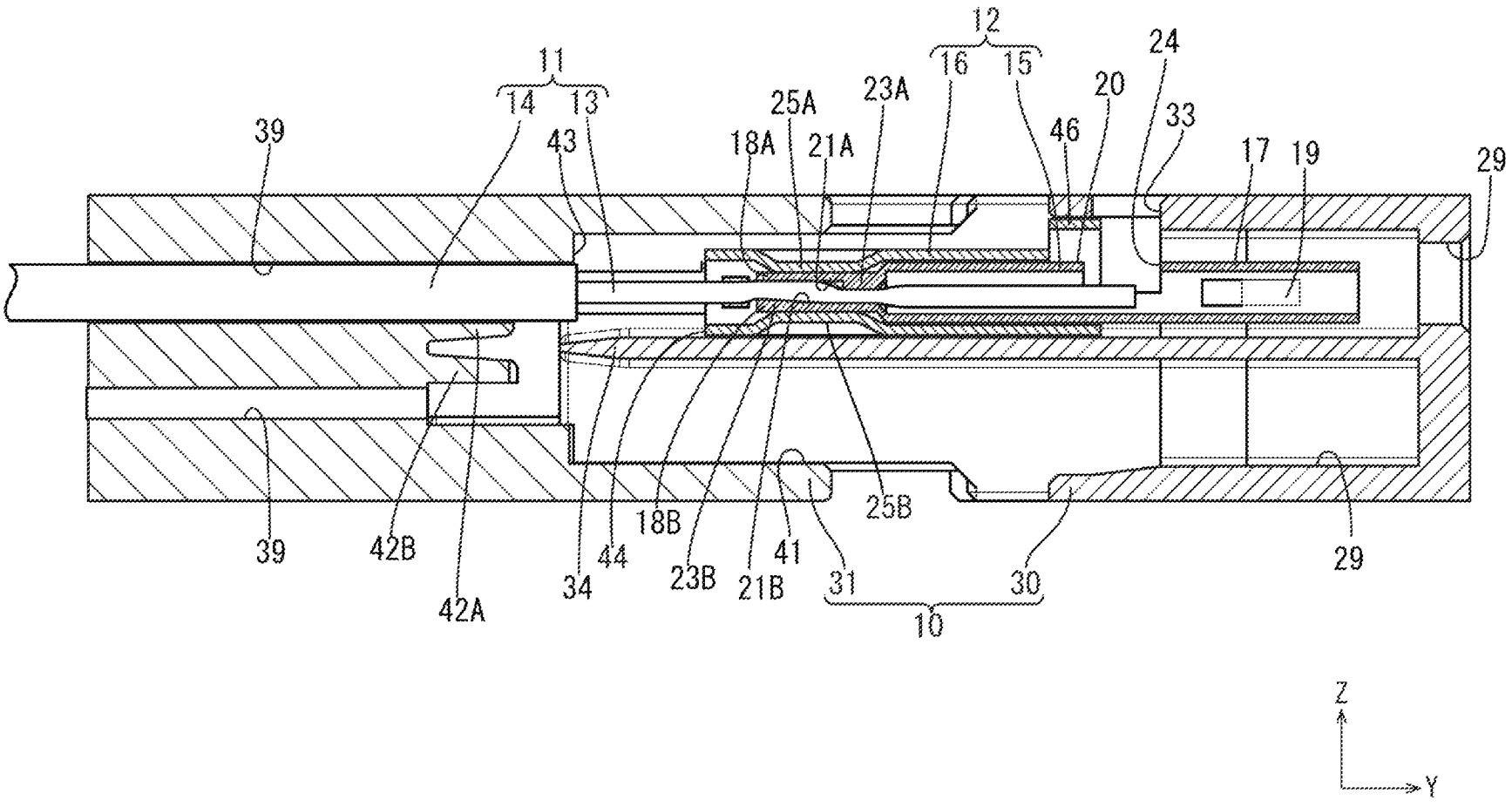
FIG. 21 is a cross-sectional view illustrating the slider permanently fitted on the terminal body inside the connector housing.

As illustrated in FIG. 20, the jig 45 is place to contact the jig contact portion 46 from the rear and the slider 16 is slid forward relative to the terminal body 15. The holding projection 28 of the terminal body 15 is removed from the temporary holding portion 26 of the slider 16 and the sidewall of the slider 16 is against the holding projection 28. The sidewall of the slider 16 expands outward.

When the slider 16 is moved farther forward, the sidewall of the slider 16 is restored and the holding projection of the terminal body 15 is elastically fitted in the permanent holding portion 27 of the slider 16. As a result, the slider 16 is held at the permanent holding position relative to the terminal body 15.

When the slider 16 is held at the permanent holding position relative to the terminal body 15, the upper abutting portion 25A of the slider 16 contacts the upper connecting piece 18A of the terminal body 15 from above and presses the upper abutting portion 25A downward. Further, the lower abutting portion 25B of the slider 16 contacts the lower connecting piece 18B of the terminal body 15 from below and presses the lower abutting portion 25B upward. As a result, the core wire 13 is sandwiched between the upper connecting piece 18A and the lower connecting piece 18B in the top-bottom direction. With the core wire 13 contacting the upper connecting piece 18A and the lower connecting piece 18B, the electric wire 11 is electrically connected to the female terminal 12 (see FIG. 21).

When the core wire 13 is sandwiched between the upper connecting piece 18A and the lower connecting piece 18B in the top-bottom direction, the core wire 13 is held to extend in the front-rear direction and bent in the top-bottom direction because the core wire 13 is sandwiched between the upper holding projection 23A of the upper connecting piece 18A and the lower holding projection 23B of the lower connecting piece 18B. Because the core wire 13 is tightly held, the connection between the electric wire 11 and the female terminal 12 is less likely to lose even if the electric wire 11 is pulled.

Next, the rear holder 31 is moved forward. The front end of the rear holder 31 is against the permanent holding lock 37 of the connector housing 30 and thus the front end expands. When the rear holder 31 is pushed forward, the front end of the rear holder 31 passes over the permanent holding lock 37. The front end is restored and the permanent holding lock 37 of the connector housing 30 is fitted in the lock receiving portion 38 of the rear holder 31. As a result, the rear holder 31 is held at the permanent holding position relative to the connecting housing 30 (see FIGS. 1 and 2).

During the moving of the slider 16 to the permanent holding position, the slider 16 may stop between the temporary holding position and the permanent holding position. In this condition, the core wire 13 is not able to establish sufficient electrical connection with the upper connecting piece 18A and the lower connecting piece 18B. This is because the upper connecting piece 18A and the lower connecting piece 18B do not sufficiently press the core wire 13. If the rear holder 31 is moved from the temporary holding position to the permanent holding position under this condition, the slider abutting portion 43 of the rear holder 31 contacts the rear end 44 of the slider 16 and thus the rear holder 31 cannot move to the permanent holding position. Whether the slider 16 is moved to the permanent holding position is determined based on the condition.

Operation and Effect of the Embodiment

Figure 22:
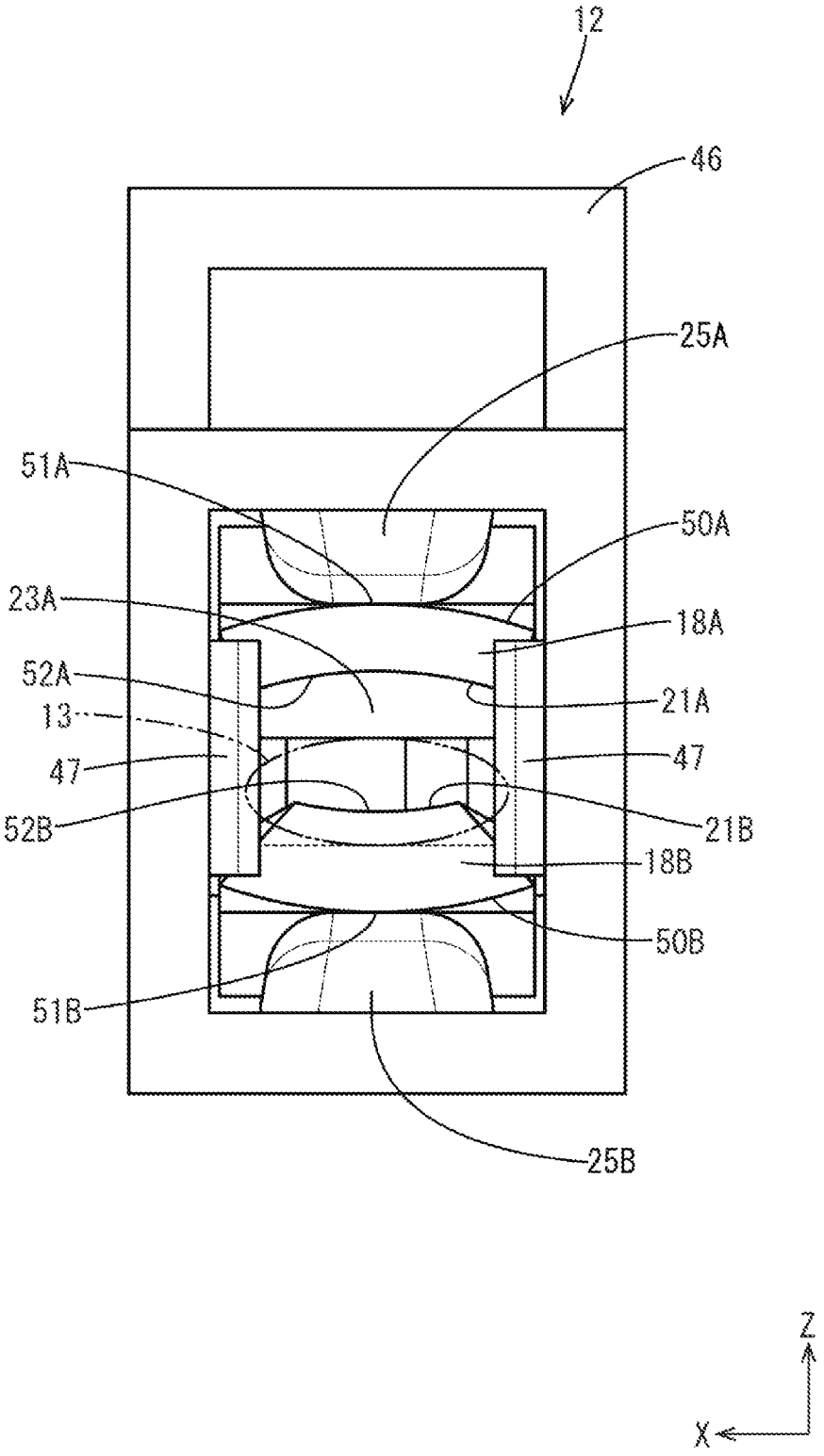
FIG. 22 is a rear view illustrating the slider permanently fitted on the terminal body.

Next, operation and effect of the embodiment will be described. As illustrated in FIG. 22, according to this embodiment, the upper abutting portion 25A of the slider 16 contacts the upper protrusion MA of the upper connecting piece 18A. The lower abutting portion 25B of the slider 16 contacts the lower protrusion MB of the lower connecting piece 18B. The contact area between the upper abutting portion 25A and the upper receiving surface 50A of the upper connecting piece 18A and the contact area between lower abutting portion 25B and the lower receiving surface 50B of the lower connecting piece 18B can be reduced in comparison to a configuration that does not include the upper protrusion MA and the lower protrusion MB. Therefore, a force for moving the slider 16 forward along the extending direction can be reduced. Buckling of the upper connecting piece 18A or the lower connecting piece 18B due to pressing by the slider 16 in the extending direction can be reduced.

In this configuration, the upper protrusion 51A incudes the convex surface that is curved in the direction from the upper contact surface 21A toward the upper receiving surface 50A (in the direction from the bottom toward the top). The lower protrusion 51B incudes the convex surface that is curved in the direction from the lower contact surface 21B toward the lower receiving surface 50B (in the direction from the top toward the bottom). According to the configuration, even if the terminal body 15 is displaced from a defined position relative to the slider 16, the contact area between the upper abutting portion 25A and the upper protrusion 51A is still small and the contact area between the lower butting portion 25B and the lower protrusion 51B is still small. Because precise relative positional alignment is not required for the terminal body 15 and the slider 16, a production cost of the female terminals 12 can be reduced.

In this configuration, the curvatures of the upper protrusion 51A and the lower protrusion 51B at the distal end portions of the upper connecting piece 18A and the lower connecting piece 18B are defined larger that the curvatures of the upper protrusion 51A and the lower protrusion 51B at the base end portions of the upper connecting piece 18A and the lower connecting piece 18B.

According to the configuration, the sections of the upper connecting piece 18A and the lower connecting piece 18B closer to the base end portions are less likely to deform in comparison to the sections closer to the distal end portions. Therefore, buckling of the sections of the upper connecting piece 18A and the lower connecting piece 18B closer to the base end portions can be reduced.

In this embodiment, the upper contact surface 21A includes the upper recess 52A that is recessed in the direction from the upper contact surface 21A toward the upper receiving surface 50A (in the direction from the bottom toward the top). The upper recess 52A extends in the front-rear direction. The lower contact surface 21B includes the lower recess 52B that is recessed in a direction from the lower contact surface 21B toward the lower receiving surface SOB (in the direction from the top toward the bottom). The lower recess 52B extends in the front-rear direction. According to the configuration, the electric wire 11 is less likely to be removed from the upper contact surface 21A and the lower contact surface 21B.

Second Embodiment

Figure 23:
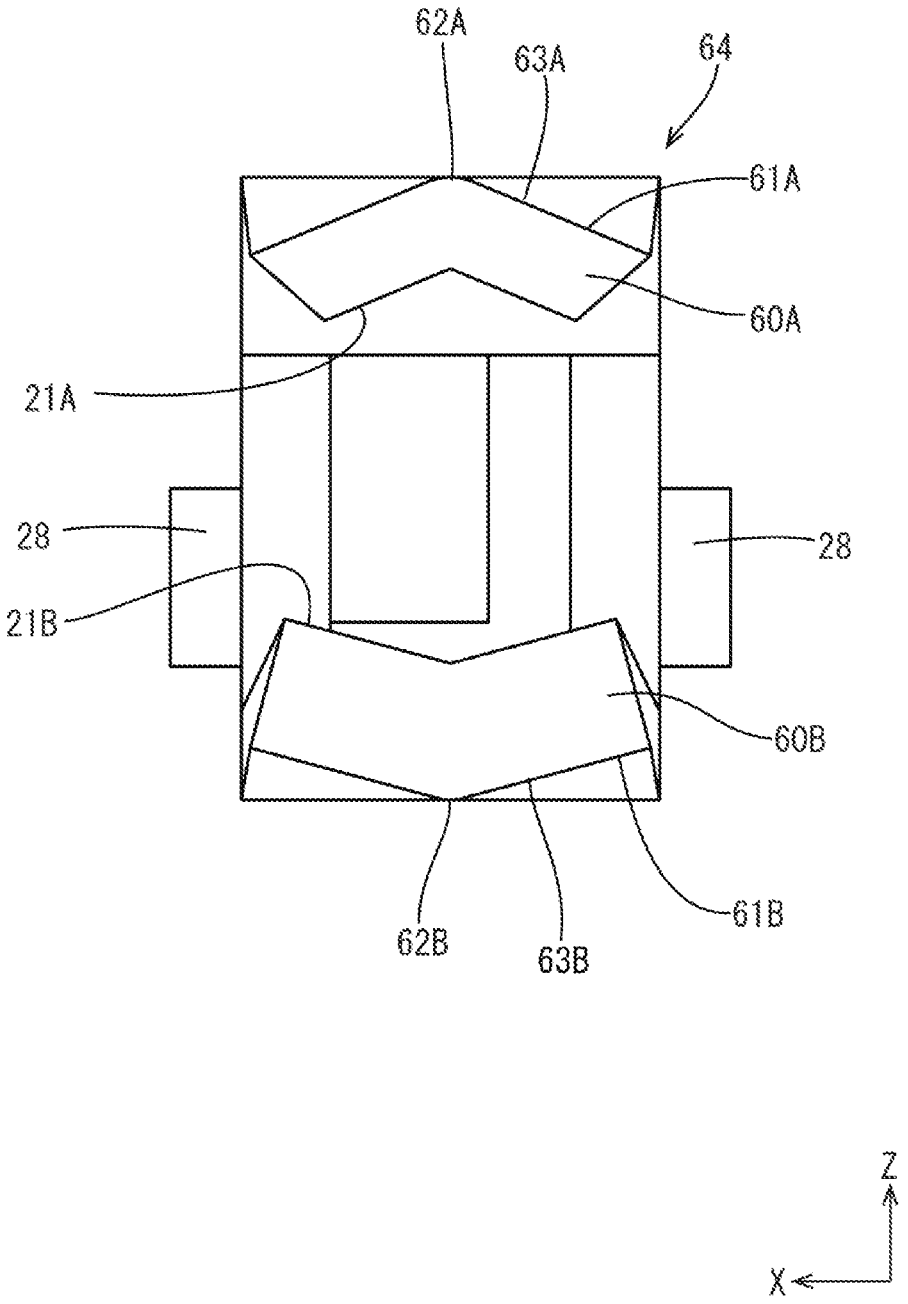
FIG. 23 is a rear view of a terminal body according to a second embodiment.

Next, a second embodiment of the technology described herein will be described with reference to FIG. 23. This embodiment includes terminals bodies 64. The terminal bodies 64 include upper connecting pieces 60A each having a plate shape extending in the front-rear direction. The upper connecting pieces 60A bend such that the middle thereof in the right-left direction are at the highest when viewed from the rear. Upper receiving surfaces 61A on the upper connecting pieces 60A include upper ridge sections 62A (an example of a ridge section) that extend in the front-rear direction.

Lower connecting pieces 60B each having a plate shape extending in the front-rear direction. The lower connecting pieces 60B bend such that the middle thereof in the right-left direction are at the lowest when viewed from the rear. Lower receiving surfaces 61B at the bottom of the lower connecting pieces 60B include lower ridge sections 62B (an example of a ridge section) that extend in the front-rear direction.

Other configurations of the second embodiment are similar to those of the first embodiment. The components that are the same as the components of the first embodiment will be indicated by the same reference signs and will not be described.

In this embodiment, the upper abutting portions 25A of the sliders 16 contact the upper ridge sections 62A of upper protrusions 63A of the upper connecting pieces 60A from above. The lower abutting portions 25B of the sliders 16 contact the lower ridge sections 62B of lower protrusions 63B of the upper connecting pieces 60A from below. According to the configuration, a contact area between each upper abutting portion 25A and the corresponding upper receiving surface 61A and a contact area between each lower abutting portion 25B and the corresponding lower receiving surface 61B can be reduced. When the upper connecting pieces 60A and the lower connecting pieces 60B are pressed by the sliders 16 in the front-rear direction (the extending direction), buckling of the upper connecting pieces 60A and the lower connecting pieces 60B can be reduced.

Third Embodiment

Figure 24:
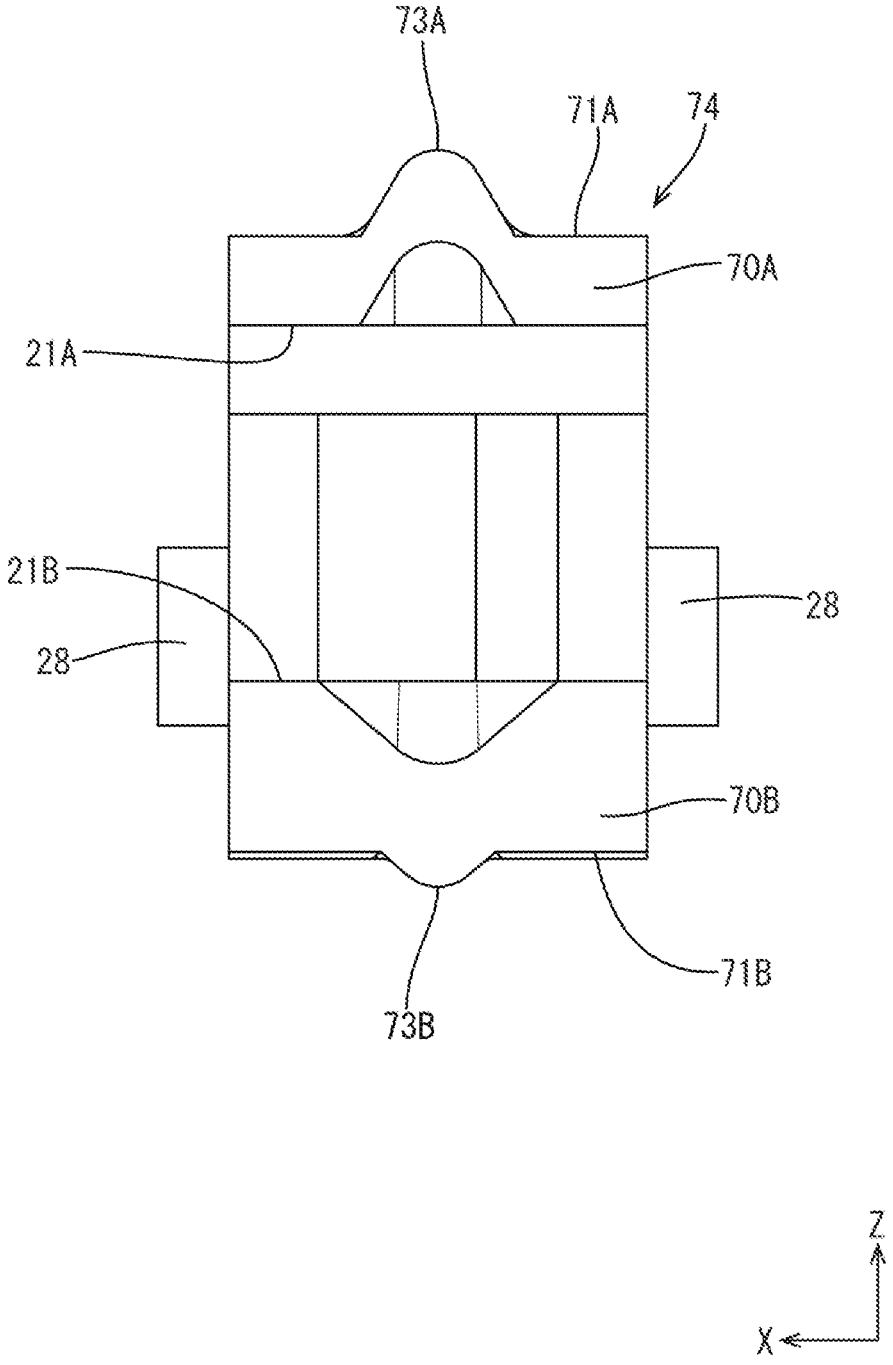
FIG. 24 is a rear view of a terminal body according to a third embodiment.

A third embodiment of the technology described herein will be described with reference to FIG. 24. This embodiment includes terminal bodies 74 that include upper connecting pieces 70A. Each of the upper connecting pieces 70A has a plate shape that is elongated in the front-rear direction. Each upper connecting piece 70A includes a middle portion that protrudes upward, when viewed from the rear, at the middle in the right-left direction. An upper surface of each upper connecting piece 70A includes an upper receiving surface 71A that includes an upper convex section 73A extending in the front-rear direction.

The terminal bodies 74 include lower connecting pieces 70B. Each of the lower connecting pieces 70B has a plate shape that is elongated in the front-rear direction. Each lower connecting piece 70B includes a middle portion that protrudes downward, when viewed from the rear, at the middle in the right-left direction. A lower surface of each lower connecting piece 70B includes a lower receiving surface 71B that includes a lower convex section 73B extending in the front-rear direction.

Configurations other than those described above are the same as those of the first embodiment. The same components as those of the first embodiment are indicated by the same reference symbols as those in the first embodiment and will not be repeatedly described.

According to this embodiment, the upper abutting portions 25A on the sliders 16 contact the upper protrusions 73A of the upper connecting pieces 70A from above. The lower abutting portions 25B on the sliders 16 contact the lower protrusions 73B of the lower connecting pieces 70B from below. According to the configuration, the contact area between each upper abutting portion 25A and the corresponding upper receiving surface 71A and the contact area between the lower abutting portion 25B and the lower receiving surface 71B can be reduced. Therefore, the upper connecting pieces 70A and the lower connecting pieces 70B are less likely to buckle when pressed by the sliders 16 in the front-rear direction (the extending direction).

Other Embodiments

The technology disclosed herein is not limited to the embodiment described above and illustrated in the drawings. For example, the following embodiments will be included in the technical scope of the technology.

(1) In the first embodiment, the upper connecting piece 18A and the lower connecting piece 18B are provided for each terminal body 15. However, only one connecting piece may be provided for each terminal body 15 or three or more connecting pieces may be provided for each terminal body 15.

(2) In the first embodiment, the female terminals 12 are provided. However, male terminals or ring terminals including round plate terminals with bolt insertion holes may be provided instead of the female terminals 12.

(3) One of or both of the upper contact surface 21A of each upper connecting piece 18A and the lower contact surface 21B of each lower connecting piece 18B may include serration including recesses or protrusions.

(4) In the first embodiment, the terminal bodies 15 include the terminal windows 24 and the connector housing 30 includes the connector windows 33. However, the terminal windows 24 may be omitted. Further, the connector windows 33 may be omitted.

(5) In the first embodiment, the sliders 16 include the guiding portions 47. However, the guiding portions 47 may be omitted.

(6) In the first embodiment, the cavities 29 are arranged on two levels. However, the cavities 29 may be arranged on one level or three or more levels.

(7) In the first embodiment, the sliders 16 are made of metal. However, the sliders 16 may be made of any material such as synthetic resin and ceramic.

(8) In the first embodiment, the upper connecting pieces 18A and the lower connecting pieces 18B are elastically deformable. However, the upper connecting pieces 18A and the lower connecting pieces 18B may be plastically deformable.

(9) In the first embodiment, the electric wires 11 are the covered electric wires including the core wires 13 and the insulating sheaths 14 covering the core wires 13. However, the electric wires 11 may be bare wires.

(10) In the first embodiment, each slider 16 has the rectangular tube shape. However, each slider 16 may have a round tube shape, a triangular tube shape, a pentagonal tube shape, a hexagonal tube shape, or any other polygonal tube shape.

(11) In the first embodiment, the jig 45 is pressed against the jig contact portions 46 of the sliders 16 from the rear and pushed forward to slide the sliders 16 forward. However, the rear holder 31 may be moved from the temporary holding position to the permanent holding position so that the slider abutting portion 43 of the rear holder 31 is pressed against the rear ends of the sliders 16 and then the rear holder 31 is pushed forward to slide the sliders 16 forward.

DESCRIPTION OF SYMBOLS

11: Electric wire
12: Female terminal (an example of a terminal)
15, 64, 74: Terminal body
16: Slider
18A, 60A, 70A: Upper connecting piece (an example of a connecting piece)
18B, 60B, 70B: Lower connecting piece (an example of a connecting piece)
21A: Upper contact surface (an example of contact surface)
21B: Lower contact surface (an example of contact surface)
25A: Upper abutting portion (an example of an abutting portion)
25B: Lower abutting portion (an example of an abutting portion)
50A, 61A, 71A: Upper receiving surface (an example of a receiving surface)
50B, 61B, 71B: Lower receiving surface (an example of a receiving surface)
51A, 63A: Upper protrusion (an example of a protrusion)
51B, 63B: Lower protrusion (an example of a protrusion)
52A: Upper recess (an example of a recess)
52B: Lower recess (an example of a recess)
62A: Upper ridge section (an example of a ridge section)
62B: Lower ridge section (an example of a ridge section)

What is claimed is:

1. A terminal comprising:
a terminal body including at least one connecting piece extending in an extending direction and being deformable, the at least one connecting piece including:
a contact surface contacting an electric wire; and
a receiving surface on an opposite side from the contact surface; and
a slider movable in the extending direction relative to the terminal body, wherein
the slider has a tube shape,
the slider is fitted on a section of the terminal body including the connecting piece,
the slider includes an abutting portion that abuts against the receiving surface of the at least one connecting piece and presses the at least one connecting piece against the electric wire that is disposed on the contact surface of the at least one connecting piece along the extending direction,
the abutting portion protrudes inward from an inner surface of a wall of the slider,
the abutting portion abuts against the connecting piece when the slider is slid on the terminal body to a contact position,
the at least one connecting piece includes a protrusion protruding from a section of the receiving surface in a direction from the contact surface toward the receiving surface, and
a cross-sectional shape of the receiving surface of the protrusion is different from a cross-sectional shape of a surface of the abutting portion facing the protrusion.

2. The terminal according to claim 1, wherein the protrusion incudes a convex surface that is curved in a direction from the contact surface toward the receiving surface.

3. The terminal according to claim 2, wherein the protrusion has a curvature that is larger at a distal end of the at least one connecting piece than at a base end of the at least one connecting piece.

4. The terminal according to claim 1, wherein the protrusion includes a ridge section that extends in the extending direction.

5. The terminal according to claim 1, wherein
the contact surface includes a recess that is recessed in a direction from the contact surface toward the receiving surface, and
the recess extends in the extending direction.

6. The terminal according to claim 1, wherein an area of the abutting portion is substantially equal to or less than an area of the at least one connecting piece in a plan view.

7. A terminal comprising:
a terminal body including at least one connecting piece extending in an extending direction and being deformable, the at least one connecting piece including:
a contact surface contacting an electric wire; and
a receiving surface on an opposite side from the contact surface; and
a slider movable in the extending direction relative to the terminal body, wherein
the slider has a tube shape,
the slider is fitted on a section of the terminal body including the connecting piece,
the slider includes an abutting portion that abuts against the receiving surface of the at least one connecting piece and presses the at least one connecting piece against the electric wire that is disposed on the contact surface of the at least one connecting piece along the extending direction,
the abutting portion protrudes inward from an inner surface of a wall of the slider,
the abutting portion abuts against the connecting piece when the slider is slid on the terminal body to a contact position,
the at least one connecting piece includes a protrusion protruding from a section of the receiving surface in a direction from the contact surface toward the receiving surface, and
a curvature of the receiving surface of the protrusion is different from a curvature of a surface of the abutting portion facing the protrusion.

8. A terminal comprising:

a terminal body including at least one connecting piece extending in an extending direction and being deformable, the at least one connecting piece including:

a contact surface contacting an electric wire; and a receiving surface on an opposite side from the contact surface; and a slider movable in the extending direction relative to the terminal body, wherein the slider has a tube shape, the slider is fitted on a section of the terminal body including the connecting piece, the slider includes an abutting portion that abuts against the receiving surface of the at least one connecting piece and presses the at least one connecting piece against the electric wire that is disposed on the contact surface of the at least one connecting piece along the extending direction, the abutting portion protrudes inward from an inner surface of a wall of the slider, the abutting portion abuts against the connecting piece when the slider is slid on the terminal body to a contact position, the at least one connecting piece includes a protrusion protruding from a section of the receiving surface in a direction from the contact surface toward the receiving surface, and in a cross-sectional view taken perpendicular to the extending direction at a contact point between the connecting piece and the abutting portion when the slider is slid to the contact position, a width of the connecting piece in contact with the abutting portion is less than a total width of the connecting piece.

* * * * *